US009868578B2

(12) United States Patent
Ridgeway

(10) Patent No.: US 9,868,578 B2
(45) Date of Patent: Jan. 16, 2018

(54) RETENTION FRAME FOR A PACKAGING ASSEMBLY

(71) Applicant: Sealed Air Corporation (US), Charlotte, NC (US)

(72) Inventor: Devin Ridgeway, Chula Vista, CA (US)

(73) Assignee: Sealed Air Corporation, Charlotte, NC (US)

( * ) Notice: Subject to any disclaimer, the term of this patent is extended or adjusted under 35 U.S.C. 154(b) by 0 days.

(21) Appl. No.: 15/521,671

(22) PCT Filed: Oct. 29, 2015

(86) PCT No.: PCT/US2015/058049

§ 371 (c)(1),
(2) Date: Apr. 25, 2017

(87) PCT Pub. No.: WO2016/069893

PCT Pub. Date: May 6, 2016

(65) Prior Publication Data

US 2017/0247163 A1 Aug. 31, 2017

Related U.S. Application Data

(60) Provisional application No. 62/073,269, filed on Oct. 31, 2014.

(51) Int. Cl.
*B65D 81/02* (2006.01)
*B65D 81/05* (2006.01)
(Continued)

(52) U.S. Cl.
CPC ..... *B65D 81/05* (2013.01); *B65B 5/04* (2013.01); *B65D 5/5028* (2013.01); *B65D 81/07* (2013.01)

(58) Field of Classification Search
CPC ..... B65D 5/04; B65D 5/5028; B65D 81/05; B65D 81/07; B65D 81/075
(Continued)

(56) References Cited

U.S. PATENT DOCUMENTS 4,606,459 A 8/1986 Luray
4,852,743 A 8/1989 Ridgeway
(Continued)

FOREIGN PATENT DOCUMENTS

EP 1561693 A1 8/2005
JP 2002362638 A 12/2002

OTHER PUBLICATIONS

Written Opinion of the International Searching Authority, dated Jan. 15, 2016.
International Search Report, dated Jan. 15, 2016.

*Primary Examiner* — Luan K Bui
(74) *Attorney, Agent, or Firm* — Jon M. Isaacson

(57) ABSTRACT

A frame useful for retaining a product includes a frame and a sheet. The panel includes a central portion and right and left retention flaps extending from the central portion. The panel also includes right and left front pieces moveable to an engaged position coupled with the right and left retention flaps, respectively. The sheet includes a front retaining portion extending between the right and left front pieces and a front remainder portion at least partially overlaying the central portion of the panel. The right and left front pieces in the engaged position connect the front retaining portion of the sheet to the right and left retention flaps, respectively. When the right and left front pieces are both in their engaged positions, the front retaining portion of the sheet extends over the central portion of the panel. The frame is positionable in a retained position having the right and left front pieces in their respective engaged positions and the right and left retention flap folded to extend beneath the central
(Continued)

portion. The front retaining portion may be tensioned to retain the product between the front retaining portion and the front remainder portion of the sheet.

20 Claims, 26 Drawing Sheets

(51) Int. Cl.
*B65D 5/50* (2006.01)
*B65B 5/04* (2006.01)
*B65D 81/07* (2006.01)

(58) Field of Classification Search
USPC ..... 206/521, 583, 591–594
See application file for complete search history.

(56) References Cited

U.S. PATENT DOCUMENTS 4,923,065 A 5/1990 Ridgeway
5,056,665 A 10/1991 Boecker et al.
5,071,009 A 12/1991 Ridgeway
5,287,968 A 2/1994 Ridgeway
5,388,701 A 2/1995 Ridgeway
5,579,917 A 12/1996 Lofgren et al.
5,669,506 A 9/1997 Lofgren et al.
5,676,245 A 10/1997 Jones
5,678,695 A 10/1997 Ridgeway et al.
5,694,744 A 12/1997 Jones
5,893,462 A 4/1999 Ridgeway
5,894,932 A * 4/1999 Harding ..... B65D 81/075 206/583
5,967,327 A * 10/1999 Jones ..... B65D 5/5028 206/466
5,975,307 A 11/1999 Harding et al.
6,010,006 A 1/2000 Ridgeway et al.
6,073,761 A 6/2000 Jones
6,148,590 A 11/2000 Ridgeway et al.
6,148,591 A 11/2000 Ridgeway et al.
6,206,194 B1 3/2001 Beneroff et al.
6,289,655 B1 9/2001 Ridgeway et al.
6,302,274 B1 10/2001 Ridgeway
6,311,844 B1 11/2001 Ridgeway et al.
6,818,886 B2 11/2004 Tiefenthaler
6,913,147 B2 7/2005 Mueller et al.
6,920,981 B2 7/2005 Lofgren et al.
6,942,101 B2 9/2005 Lofgren et al.
7,056,534 B2 6/2006 Christenson et al.
7,150,356 B2 12/2006 Lofgren et al.
7,290,662 B2 11/2007 Lofgren et al.
7,743,924 B2 6/2010 McDonald et al.
7,753,209 B2 7/2010 McDonald et al.
7,882,956 B2 2/2011 McDonald et al.
8,016,112 B2 * 9/2011 Kasiwabara ..... B65D 5/5028 206/521
8,714,357 B2 * 5/2014 Ridgeway ..... B65D 5/5028 206/583
2001/0047950 A1 12/2001 Beneroff et al.
2004/0178113 A1 * 9/2004 Lofgren ..... B65D 5/5028 206/583
2004/0188309 A1 * 9/2004 Kudou ..... B65D 5/5028 206/521
2006/0213803 A1 * 9/2006 Saitou ..... B65D 5/5035 206/583
2013/0233752 A1 * 9/2013 Hammerschmidt . B65D 5/5028 206/471
2014/0183097 A1 * 7/2014 LeRoy ..... B65D 75/305 206/583

* cited by examiner

RETENTION FRAME FOR A PACKAGING ASSEMBLY

This patent application claims priority from U.S. Patent Application Ser. No. 62/073,269 filed Oct. 31, 2014, which is incorporated herein in its entirety by reference Various embodiments of the presently disclosed subject matter relate to a frame useful for retaining a product, for example, to protect a packaged product during shipment by retaining the product within a box.

BACKGROUND

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "suspension packaging." In typical suspension packaging, the packaged product is suspended between two sheets each attached to opposing frames sized to fit within a corresponding box. Another type of packaging system is known as "retention packaging." In typical retention packaging, a product is retained between a sheet and a rigid backing frame to which the sheet is attached. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, each of which is incorporated herein in its entirety by reference.

While existing retention structures provide a level of protection for the packaged object, there is room for improvement, for example, by enhancing the ability of the system to adjust for packaging objects of varying sizes while maintaining efficient manufacturing of the structure.

SUMMARY

One or more embodiments of the presently disclosed subject matter may address one or more of the aforementioned problems.

A frame, useful for retaining a product, includes a frame and a sheet. The panel includes (i) left and right opposing fold lines delineating a central portion between the left and right fold lines, (ii) a right retention flap extending from the right fold line, and (iii) a left retention flap extending from the left fold line. The panel also includes a right front piece moveable, from an initial position proximal to and generally coplanar with the right retention flap, to an engaged position coupled with the right retention flap, and a left front piece moveable, from an initial position proximal to and generally coplanar with the left retention flap, to an engaged position coupled with the left retention flap. The sheet includes a front retaining portion extending between and attached to the right front piece and the left front piece, and a front remainder portion extending from the front retaining portion and at least partially overlaying the central portion of the panel. The right front piece in the engaged position connects the front retaining portion of the sheet to the right retention flap. The left front piece in the engaged position connects the front retaining portion of the sheet to the left retention flap. When the right and left front pieces are both in their engaged positions, the front retaining portion of the sheet extends over both the central portion of the panel and the front remainder portion of the sheet. The frame is positionable in a retained position having (1) the right and left front pieces in their respective engaged positions, (2) the right retention flap folded along the right fold line to extend beneath the central portion, and (3) the left retention flap folded along the left fold line to extend beneath the central portion. As a result, the front retaining portion of the sheet may be tensioned to retain a product between the front retaining portion and the front remainder portion of the sheet.

These and other objects, advantages, and features of the presently disclosed subject matter will be more readily understood and appreciated by reference to the detailed description and the drawings.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

Figure 1:
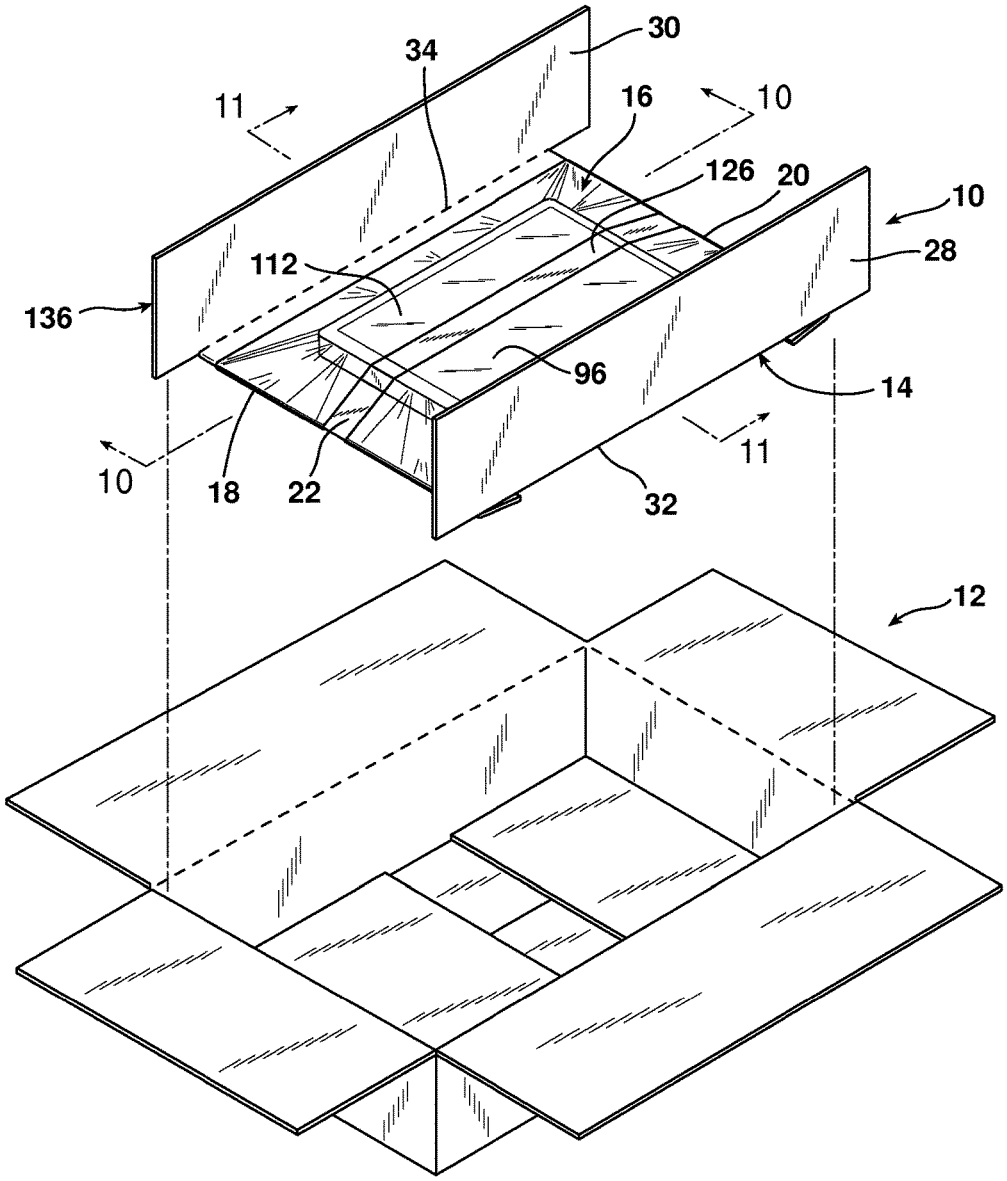
FIG. 1 is a representative perspective view of frame 10 in the retained position 136 before placement in box 12.
Figure 10:
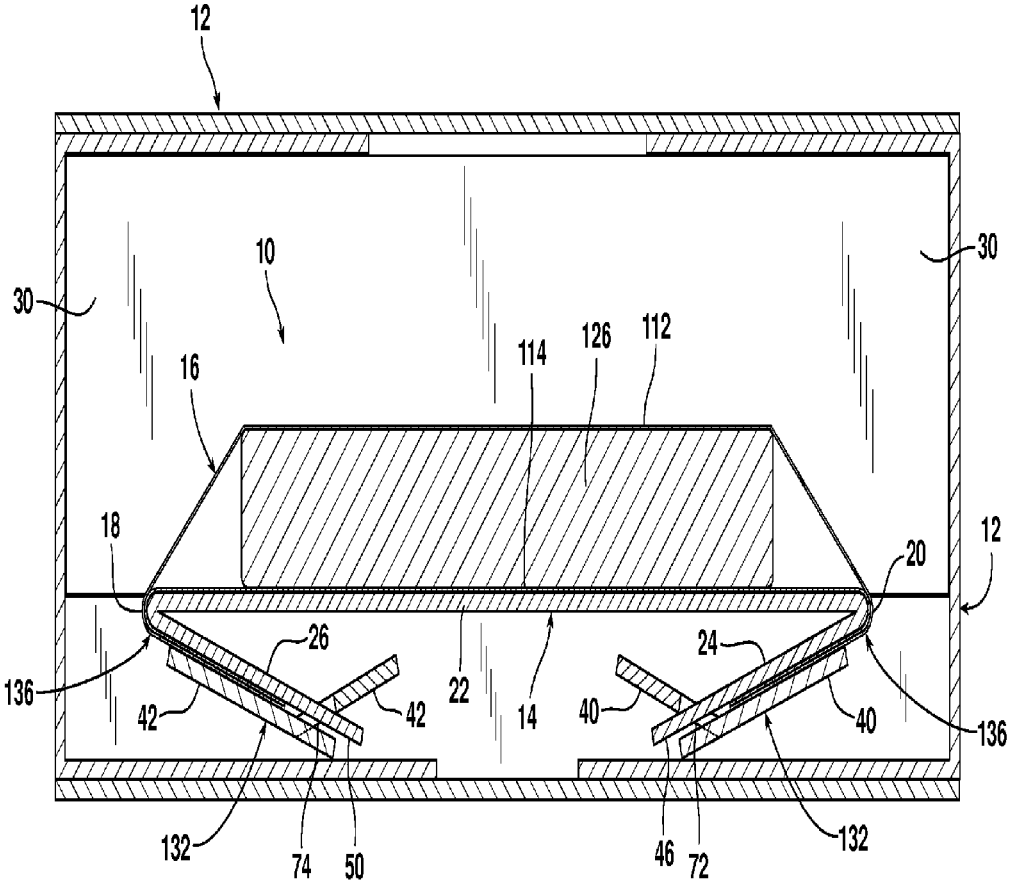
FIG. 10 is a representative section view taken along line 10-10 of FIG. 1.
Figure 11:
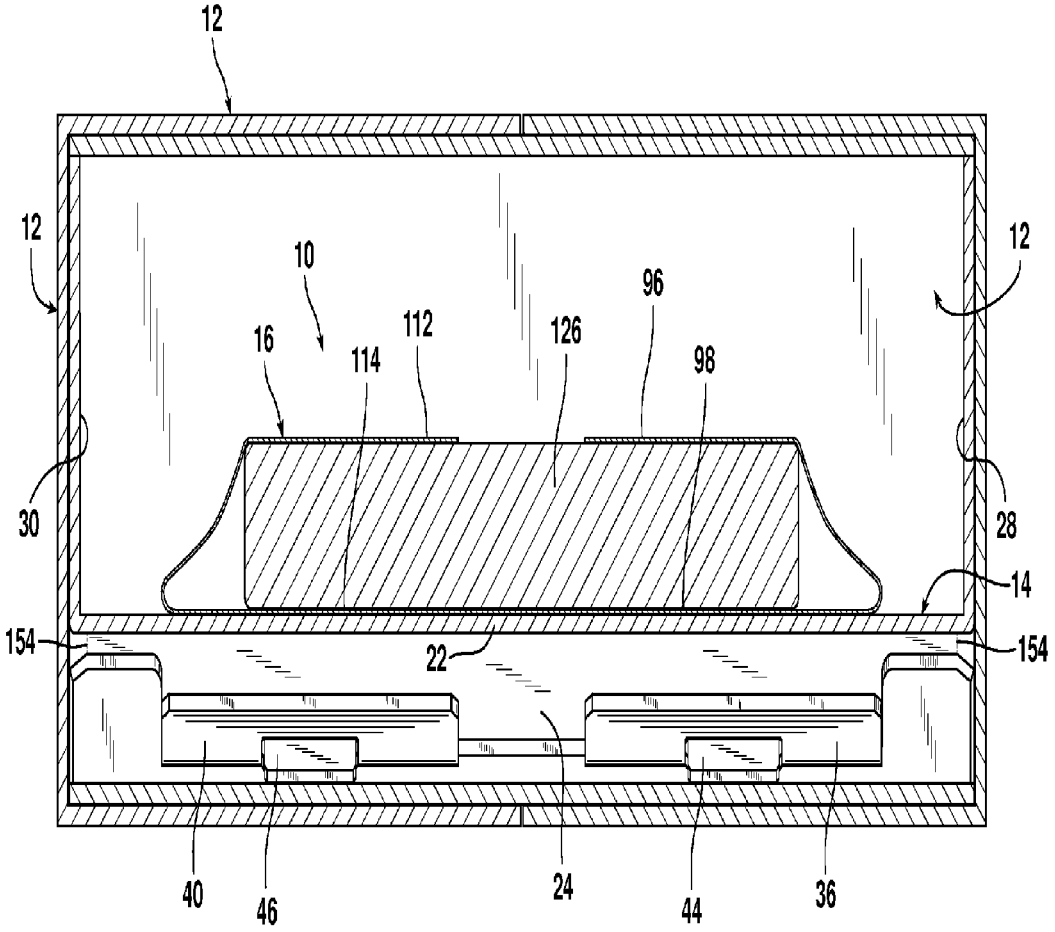
FIG. 11 is a representative section view taken along line 11-11 of FIG. 1.
Figure 12:
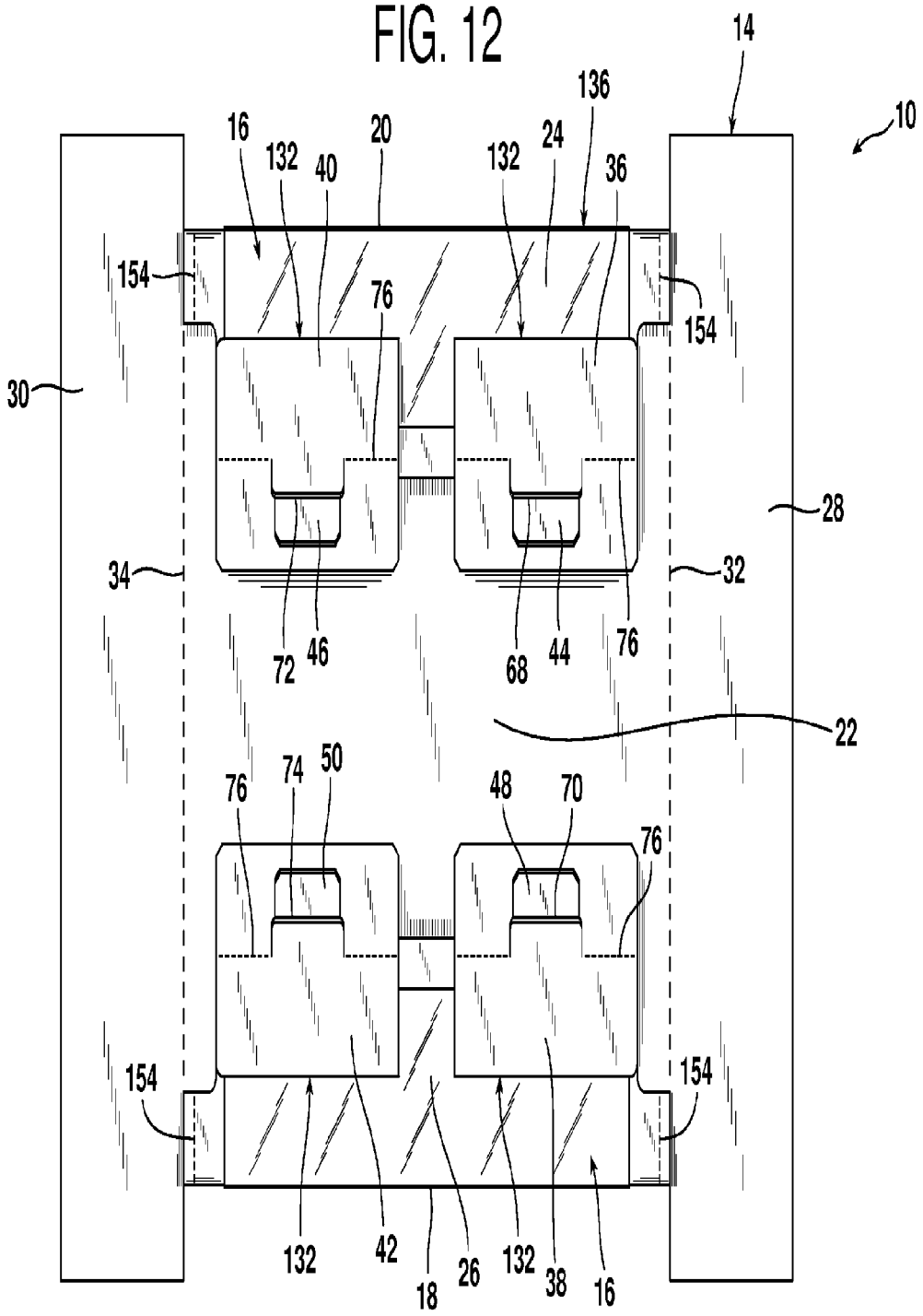
FIG. 12 is a representative bottom up plan view of frame 10 of FIG. 7, but before front and rear flaps 28, 30 have been folded along front fold line 32 and along rear fold line 34, respectively, to extend above the plane of the central portion 22.

In various embodiments of the presently disclosed subject matter, a frame (e.g., any of frame embodiments 10, 210, 310, 410, 510, 610, and 710) comprises sheet 16 attached to panel 14. (FIGS. 1-2, 14-15, 19-20, 22, and 29.) The frame may be used to retain a product (e.g., product 126) by positioning the frame in a retained position 136 (FIGS. 1, 7, 9-12). The frame in the retained position may be placed in a box. (FIGS. 1, 10-11.)

Panel

In an embodiment of the presently disclosed subject matter, panel 14 has left fold line 18 and right fold line 20 that oppose each other to delineate, or separate panel 14 into, (i) a central portion 22 between the left and right fold lines, (ii) a right retention flap 24 extending from right fold line 20, and (iii) a left retention flap 26 extending from the left fold line 18. The central panel portion may be continuous (as illustrated in frame 10 of FIG. 2), or may define one or more panel openings; for example, central panel portion 22 may define panel opening 94 (as illustrated in frame 710 of FIG. 29). Panel opening 94 of frame 710 may be larger than the product to be packaged, that is, a panel opening large enough that the packaged product could pass through the panel opening 94 if the sheet 16 were not present.

The left fold line 18 is generally parallel to the right fold line 20. As used herein, the term "generally" when used in conjunction with terms such as "parallel" or "perpendicular" or "coplanar" is meant to indicate that the parallel or perpendicular or coplanar orientation does not require mathematical precision, but rather indicates a moderate range of deviation from absolute parallel or perpendicular or coplanar that is commonly acceptable as a level of accuracy for these terms within the container-folding field. A "fold line" as used herein (and as depicted in the drawings as a broken line, for example as in FIG. 2) represents a line along which a panel, frame, or other material may be creased, crimped, embossed, perforated, scored, or otherwise weakened so as to enhance the foldability of the panel, frame, or other material along the fold line. For example, left fold line 18 may include one or more through slits (not shown) extending partially along its length, leaving a sufficient portion of the fold line intact to securely join left retention flap 26 to the central portion 22 of panel 14 so that left retention flap 26 is foldably connected to the central portion 22. The slits through the fold line may facilitate folding the left retention flap along the left fold line 18 by reducing the amount of panel material that has to be folded.

Figure 2:
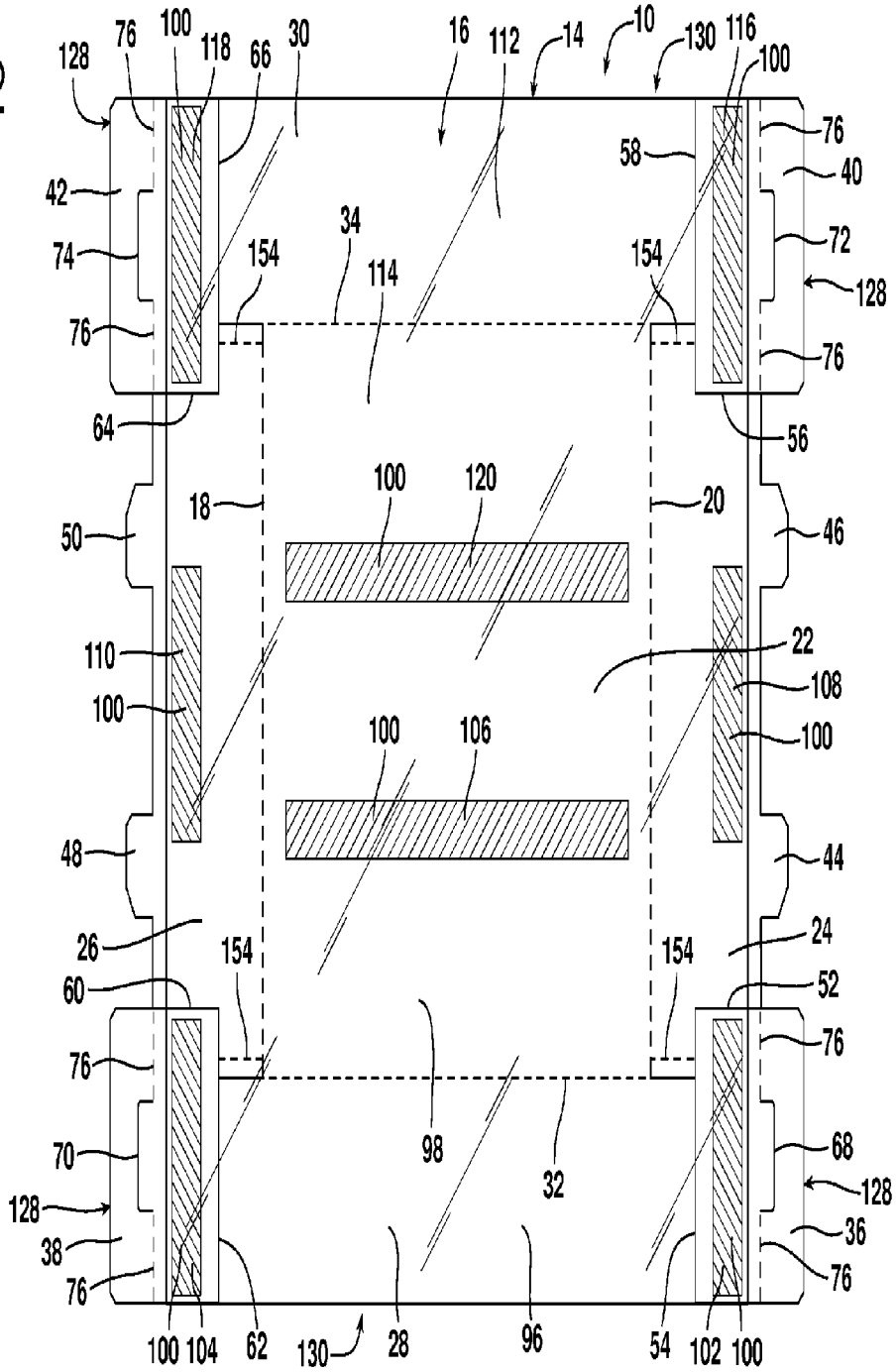
FIG. 2 is a representative top down plan view of frame 10 in the lay-flat position 130.
Figure 3:
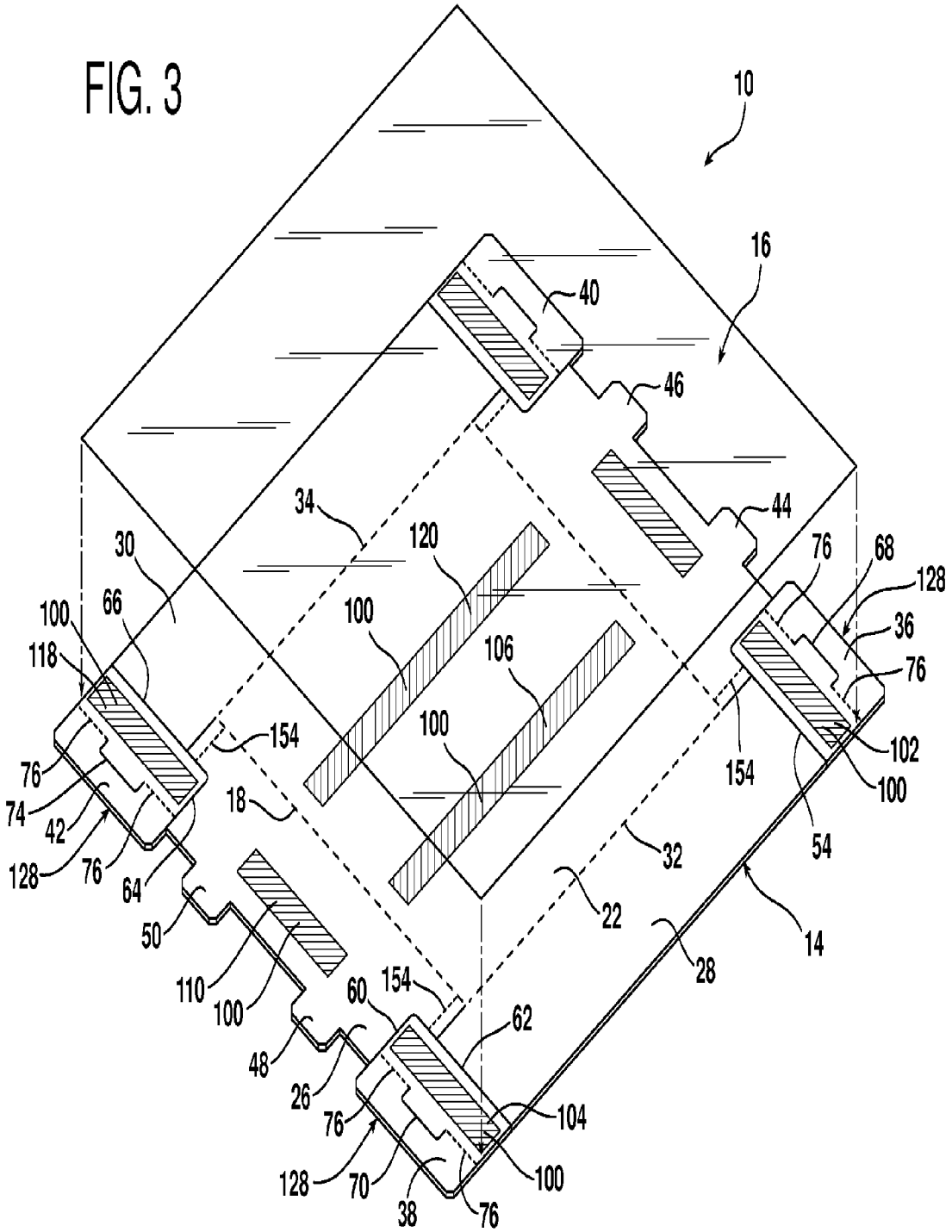
FIG. 3 is a representative exploded perspective view of frame 10 of FIG. 2.
Figure 4:
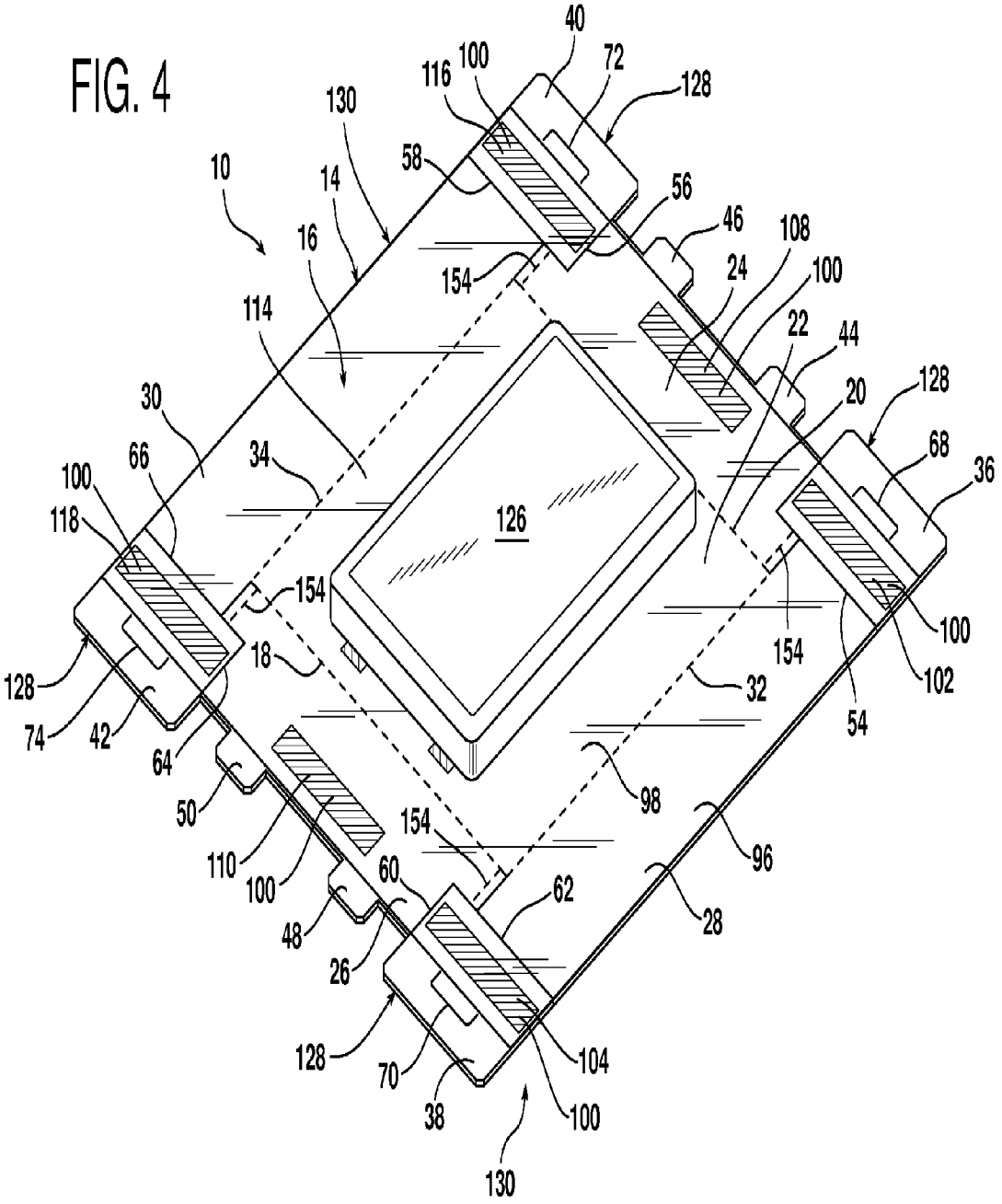
FIG. 4 is a representative perspective view of frame 10 in the lay-flat position 130 having product 126 placed on sheet 16 in the central portion 22 of panel 14.
Figure 19:
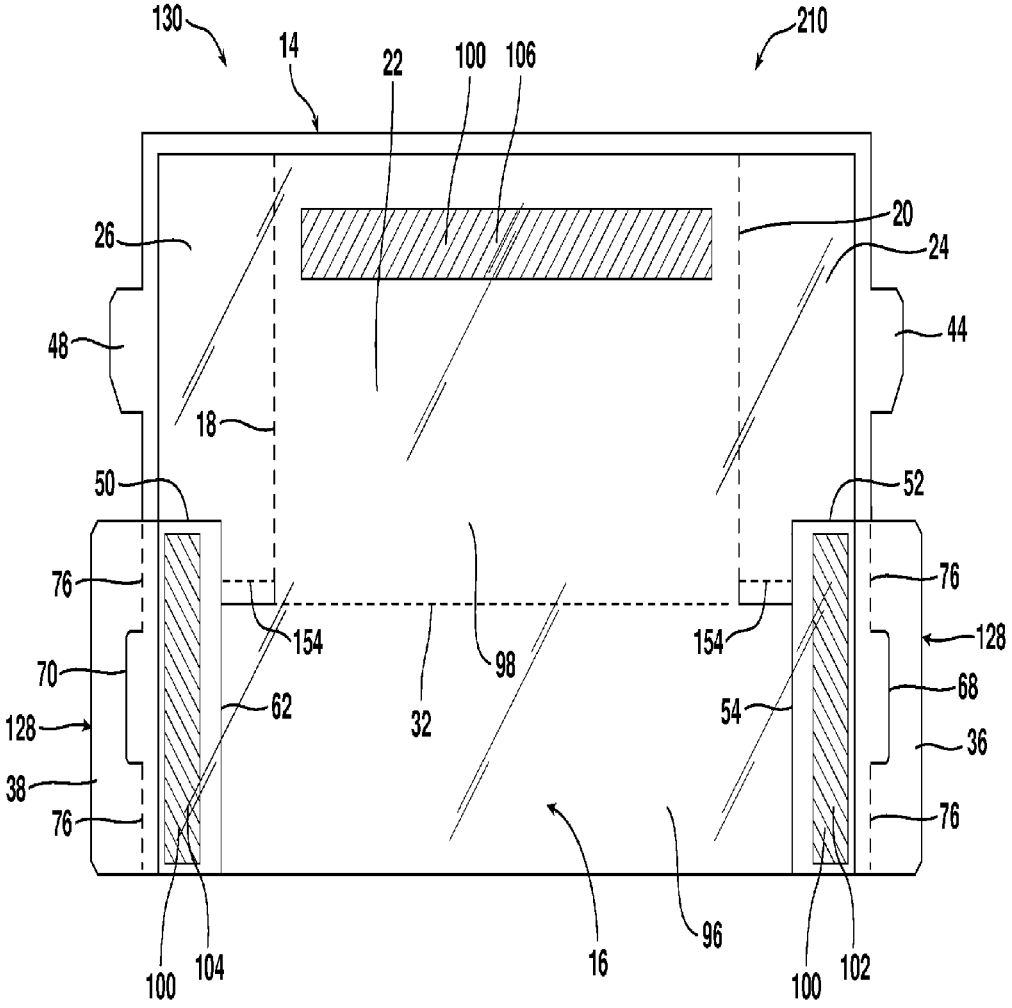
FIG. 19 is a representative top down plan view of another embodiment frame 210 in the lay-flat position 130.
Figure 20:
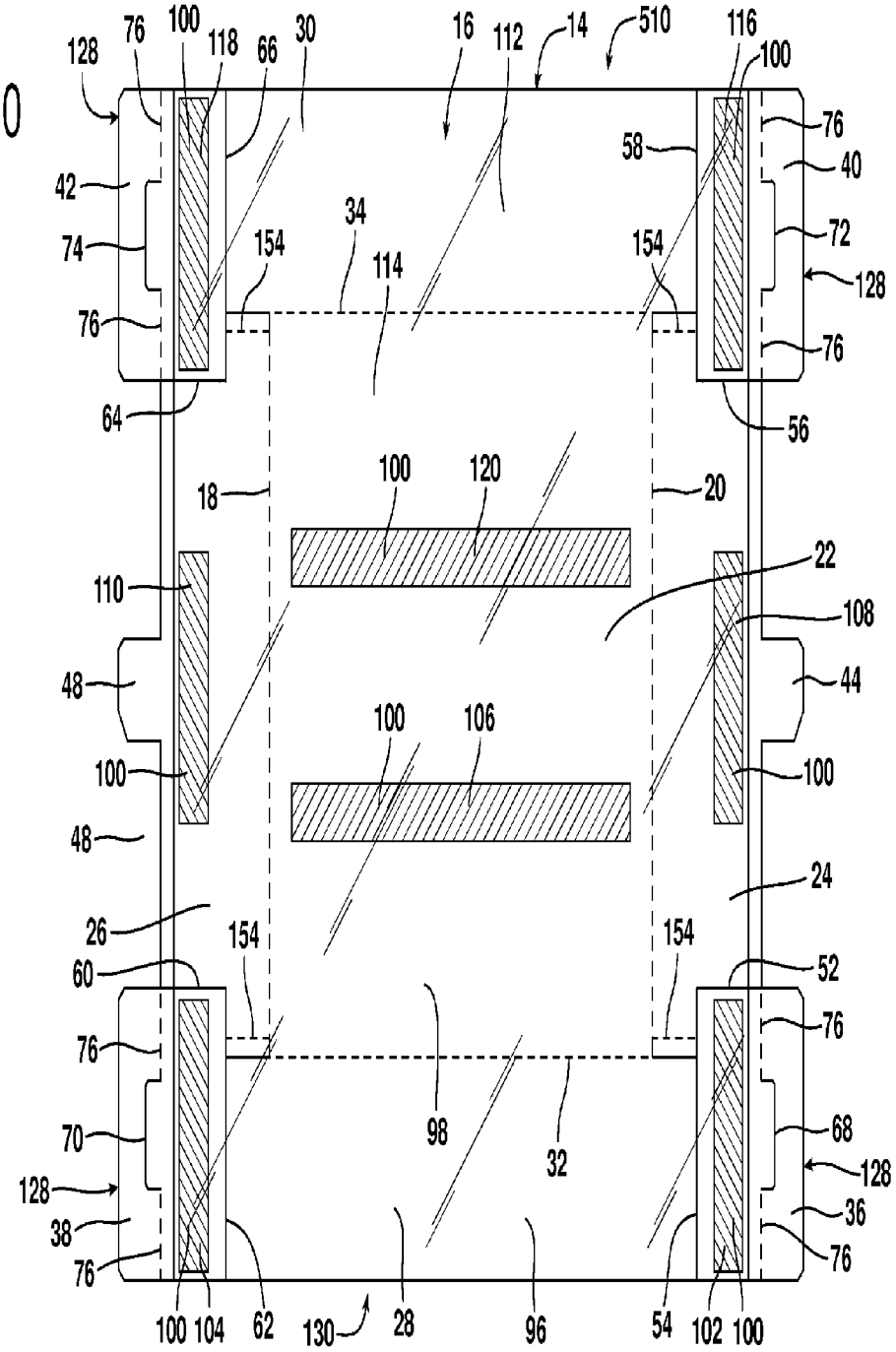
FIG. 20 is a representative top down plan view of another embodiment frame 510 in the lay-flat position 130.

Right retention flap 24 may include right front tab 44 protruding opposite right fold line 20. (FIGS. 2, 19, 20.) Right retention flap 24 may also include right rear tab 46 protruding opposite right fold line 20. (FIG. 2.) Left retention flap 26 may include left front tab 48 protruding opposite left fold line 18. (FIGS. 2, 19, 20.) Left retention flap 26 may also include left rear tab 50 protruding opposite left fold line 18. (FIG. 2.)

Panel 14 may comprise front flap 28 foldably connected to the central portion 22 along front fold line 32. (FIGS. 2, 19.) Panel 14 may comprise rear flap 30 foldably connected to the central portion 22 along rear fold line 34. (FIG. 2.) The front fold line 32 is generally parallel to the rear fold line 34. The front and rear flaps oppose each other on opposite sides of the central portion 22. The perimeter of central portion 22 may be defined at least in part by the left and right fold lines 18, 20 and the front and rear fold lines 32, 34, such that these fold lines may collectively bound (e.g., circumscribe) central panel portion 22 of panel 14. The front fold line 32 is generally perpendicular to the right fold line 20 such that the front flap 28 is generally perpendicular to the right fold line 20. The rear fold line 34 is generally perpendicular to the right fold line 20 such that the rear flap 30 is generally perpendicular to the right fold line 20.

Panel 14 comprises right front piece 36, left front piece 38, right rear piece 40, and left rear piece 42. As shown in FIG. 2, each of right front piece 36 and right rear piece 40 is in an initial position 128 proximal to and generally coplanar with the right retention flap 24; right rear piece 40 being opposite the right front piece 36. As also shown in FIG. 2, each of left front piece 38 and left rear piece 42 is in the initial position 128 proximal to and generally coplanar with the left retention flap 26; left rear piece 42 being opposite the left front piece 38. In the initial position 128, right front piece 36 may be located at the front right corner of panel 14, left front piece 38 may be located at the front left corner of panel 14, right rear piece 40 may be located at the rear right corner of panel 14, and left rear piece 42 may be located at the left rear corner of panel 14.

In the initial position 128, right front piece 36 may be detachably connected to one or more of right retention flap 24 and front flap 28, for example detachably connected to right retention flap 24 along detachment line 52 and detachably connected to front flap 28 along detachment line 54. (FIG. 2.) A "detachment line" as used herein (and as depicted in the drawings as a solid line, for example as in FIG. 2) represents a line along which the panel is weakened so as to enhance the ease of separating a portion of the panel along the detachment line. For example, detachment line 52 may include one or more through slits (not shown) extending partially along its length, leaving a sufficient portion of the detachment line intact to join right front piece 36 to right retention flap 24 so that the right front piece 36 may be held in the initial position until a relatively small force (e.g., applied by hand) will separate (e.g., snap detach) the right front piece 36 from the right retention flap 24. In this instance, the slits through the detachment line facilitate detaching the right front piece 36 along the detachment line 52 by significantly reducing the amount of panel material holding the elements together. Similarly, "detachably connected" as used herein indicates a connection between portions of the panel along a detachment line so that the detachment of the portions from each other requires relatively easy manipulation by hand.

In the initial position 128, right rear piece 40 may be detachably connected to right retention flap 24 along detachment line 56 and/or detachably connected to rear flap 30 along detachment line 58. In the initial position 128, left front piece 38 may be detachably connected to left retention flap 26 along detachment line 60 and/or detachably connected to front flap 28 along detachment line 62. In the initial position 128, left rear piece 42 may be detachably connected to left retention flap 26 along detachment line 64 and/or detachably connected to rear flap 30 along detachment line 66. (FIG. 2.)

Figure 21:
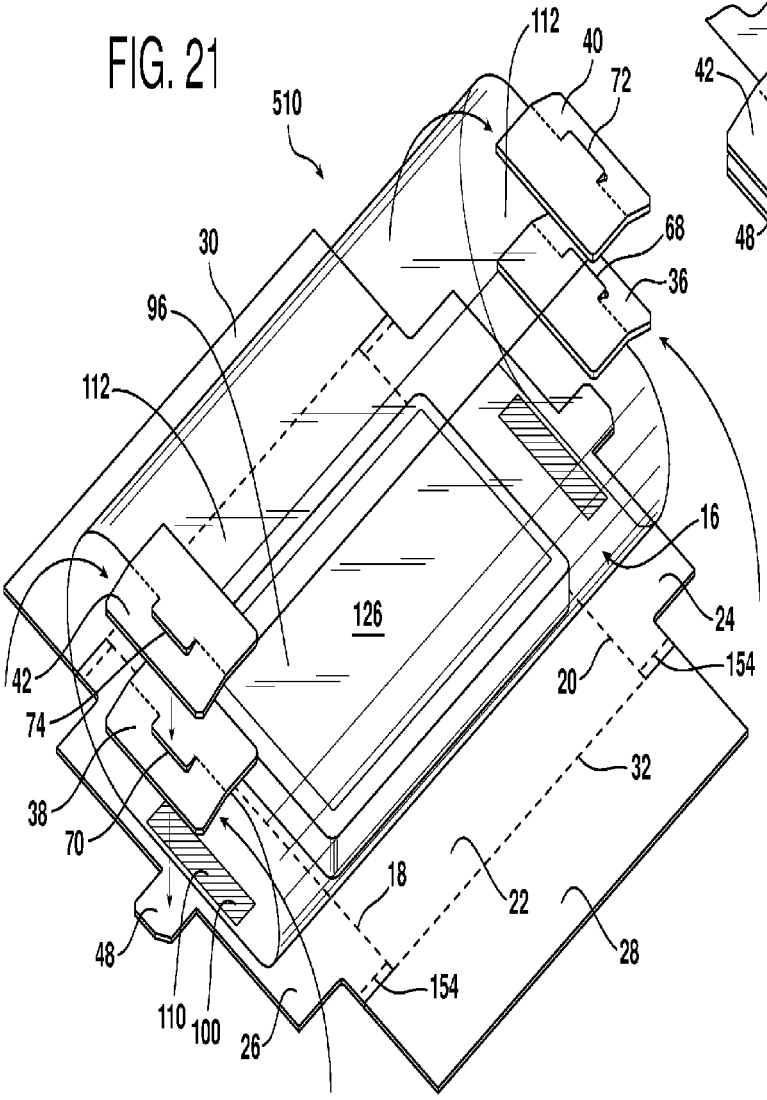
FIG. 21 is a representative perspective view of the frame 510 similar to FIG. 20, but having front right piece 36 detached from right retention flap 24, front left piece 38 detached from left retention flap 26, rear right piece 40 detached from right retention flap 24, and rear left piece 42 detached from left retention flap 26.
Figure 21A:
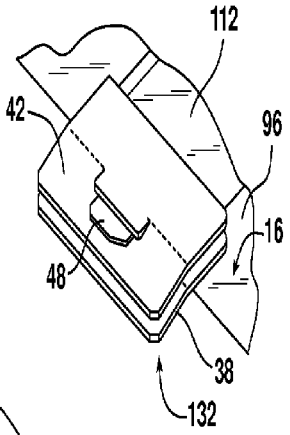
FIG. 21*a* is a representative detailed perspective view of the left front and rear pieces 38, 42 of FIG. 21, but in the engaged position coupled with left front tab 48 of the left retention flap.

The right front piece 36 may define slot 68 for receiving right front tab 44. Left front piece 38 defines slot 70 for receiving left front tab 48. (FIG. 2, 19.) In another embodiment frame 510, the right rear piece 40 defines slot 72 which may be configured for receiving right front tab 44; and the left rear piece 42 defines slot 74 which may be configured for receiving left front tab 48. (FIGS. 20-21*a*.) In the frame 10 embodiment, the right rear piece 40 defines slot 72 for receiving right rear tab 46; and the left rear piece 42 defines slot 74 for receiving left rear tab 50. (FIG. 2.)

The panel pieces defining a slot (e.g., right front piece 36 defining slot 68) may include one or more slot fold lines 76 to facilitate the opening of the slot by folding along the fold line.

In some embodiments of the presently disclosed subject matter, the right front piece 36 may be foldably connected to right retention flap 24, for example, foldably connected along one or more of primary fold line 78 and supplemental fold line 80 (which is offset angled relative primary fold line 78), as illustrated with the frame 410 embodiment of FIGS. 15 to 18. Right rear piece 40 may be foldably connected to right retention flap 24, for example, foldably connected along one or more of primary fold line 82 and supplemental fold line 84 (which is offset angled relative primary fold line 82) of frame 410. Left front piece 38 may be foldably connected to left retention flap 26, for example, foldably connected along one or more of primary fold line 86 and supplemental fold line 88 (which is offset angled relative primary fold line 86). Left rear piece 42 may be foldably connected to left retention flap 26, for example, foldably connected along one or more of primary fold line 90 and supplemental fold line 92 (which is offset angled relative primary fold line 90) of frame 410. (FIGS. 15-18.)

Figure 23:
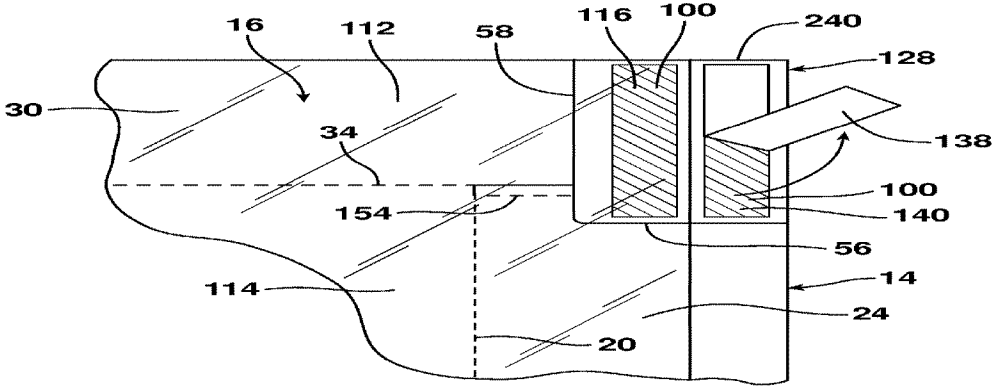
FIG. 23 is a representative top down plan view of right rear piece 240 in the initial position 128.

FIG. 23 shows another structure for coupling any of the right front, left front, right rear, and left rear pieces with their respective retention flap by illustrating exemplary right rear piece 240 having adhesive 100 in zone 116 for attaching sheet 16 to the right rear piece and adhesive 100 in zone 140 covered by releasable liner 138.

Figure 24:
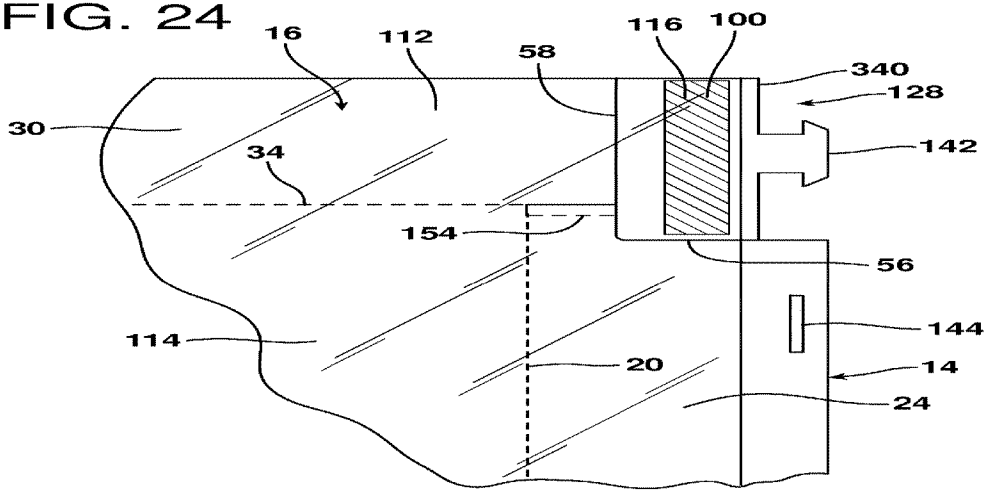
FIG. 24 is a representative top down plan view of right rear piece 340 in the initial position 128.

FIG. 24 shows another structure for coupling any of the right front, left front, right rear, and left rear pieces with their respective retention flaps by illustrating exemplary right rear piece 340 having adhesive 100 in zone 116 attaching sheet 16 to the right rear piece, protuberance 142 configured for locking insertion into slot 144 on right retention flap 24, which is configured to receive protuberance 142 to couple the right rear piece with the right retention flap.

Figure 25:
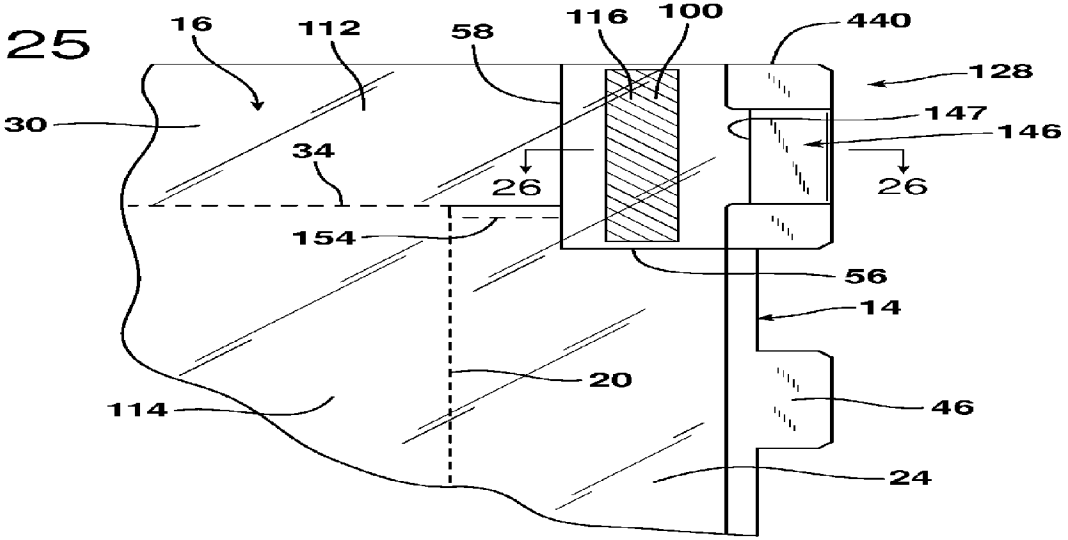
FIG. 25 is a representative top down plan view of right rear piece 440 in the initial position 128.
Figure 26:
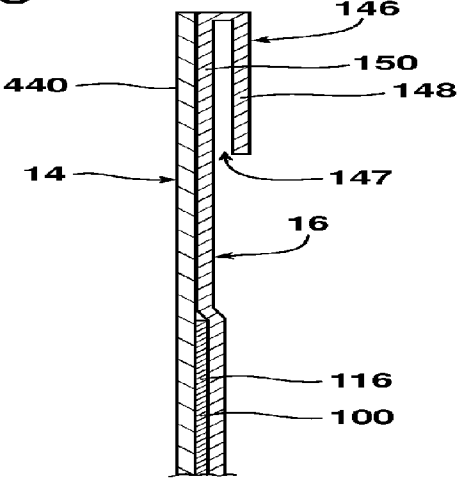
FIG. 26 is a representative section view taken along the line 26-26 of FIG. 25.

FIGS. 25 to 26 show another structure for coupling any of the right front, left front, right rear, and left rear pieces with their respective retention flaps by illustrating exemplary right rear piece 440 having adhesive 100 in zone 116 attaching sheet 16 to the right rear piece. Sheet 16 forms sleeve 146 having front portion 148 and back portion 150 sealed in the perimeter to form the sleeve having sleeve opening 147, configured to receive right rear tab 46 in sleeve 146 between the front and back portions 148, 150 to couple the right rear piece with the right retention flap.

Figure 27:
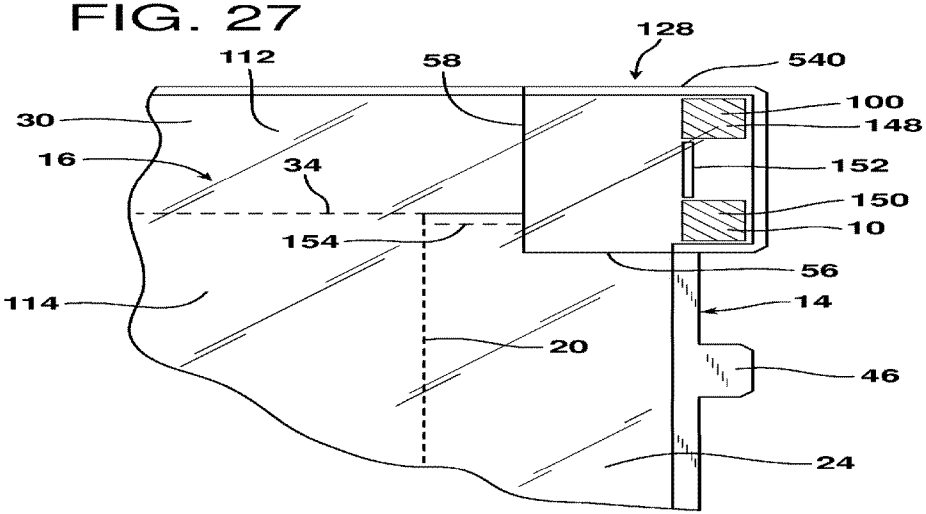
FIG. 27 is a representative top down plan view of right rear piece 540 in the initial position 128.
Figure 28:
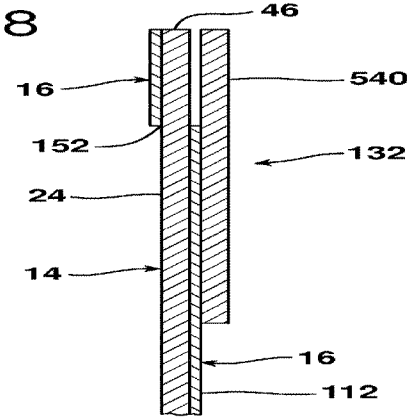
FIG. 28 is a representative sectional side view of the right rear piece 540 of FIG. 27, but in the engaged position 132 coupled with right retention flap 24.

FIGS. 27 to 28 show another structure for coupling any of the right front, left front, right rear, and left rear pieces with their respective retention flaps by illustrating exemplary right rear piece 540 having adhesive 100 in left zone 148 and right zone 150 attaching sheet 16 to the right rear piece leaving an unattached gap where sheet 16 defines slot 152. Slot 152 in sheet 116 is configured to receive right rear tab 46. FIG. 28 shows a side view cross-section of the right rear piece 540 engaged with right retention flap 24 by the insertion of right rear tab 46 through slot 152 of sheet 16, thereby coupling the right rear piece with the right retention flap.

Panel 14 may define one or more relief scores 154, for example between the retention flap 24, 26 and the adjacent front or rear flap 28, 30. The relief scores 154 may facilitate the folding of the frame.

Frame 10 as shown in FIG. 2 is in the lay-flat position 130 having the right and left front pieces 36, 38 and the right and left rear pieces 40, 42 in the initial position 128, and the right and left retention flaps 24, 26 generally coplanar with central portion 22.

Panel 14, and any of the panels and frames of the various embodiments described herein, may comprise a substantially rigid, lightweight, foldable material, for example, panel 14, or any of the portions of panel 14 described herein, may be formed of one or more of any of the following materials: cellulosic-based materials (e.g., cardboard, corrugated cardboard, paperboard), plastic, and compressed foam. For example, panel 14 may comprise corrugated cardboard, for example, any of single-wall B-flute, C-flute, and/or E-flute corrugated cardboard, B/C double-wall corrugated cardboard, and/or E/B double-wall corrugated cardboard. The panel, and any of the panels and frames of the various embodiments described herein, may have an average thickness of, for example, at most about, and/or at least about, any of the following thicknesses: 0.03, 0.06, 0.12, 0.18, 0.25, 0.3, 0.4, and 0.5 inches.

Sheet

Sheet 16 is attached to the panel 14. Sheet 16 includes a front retaining portion 96 extending between and attached to the right front piece 36 and the left front piece 38. (FIGS. 2, 19.) In some embodiments, sheet 16 further includes a rear retaining portion 112 extending between and attached to the right rear piece 40 and the left rear piece 42. (FIG. 2.)

Figure 29:
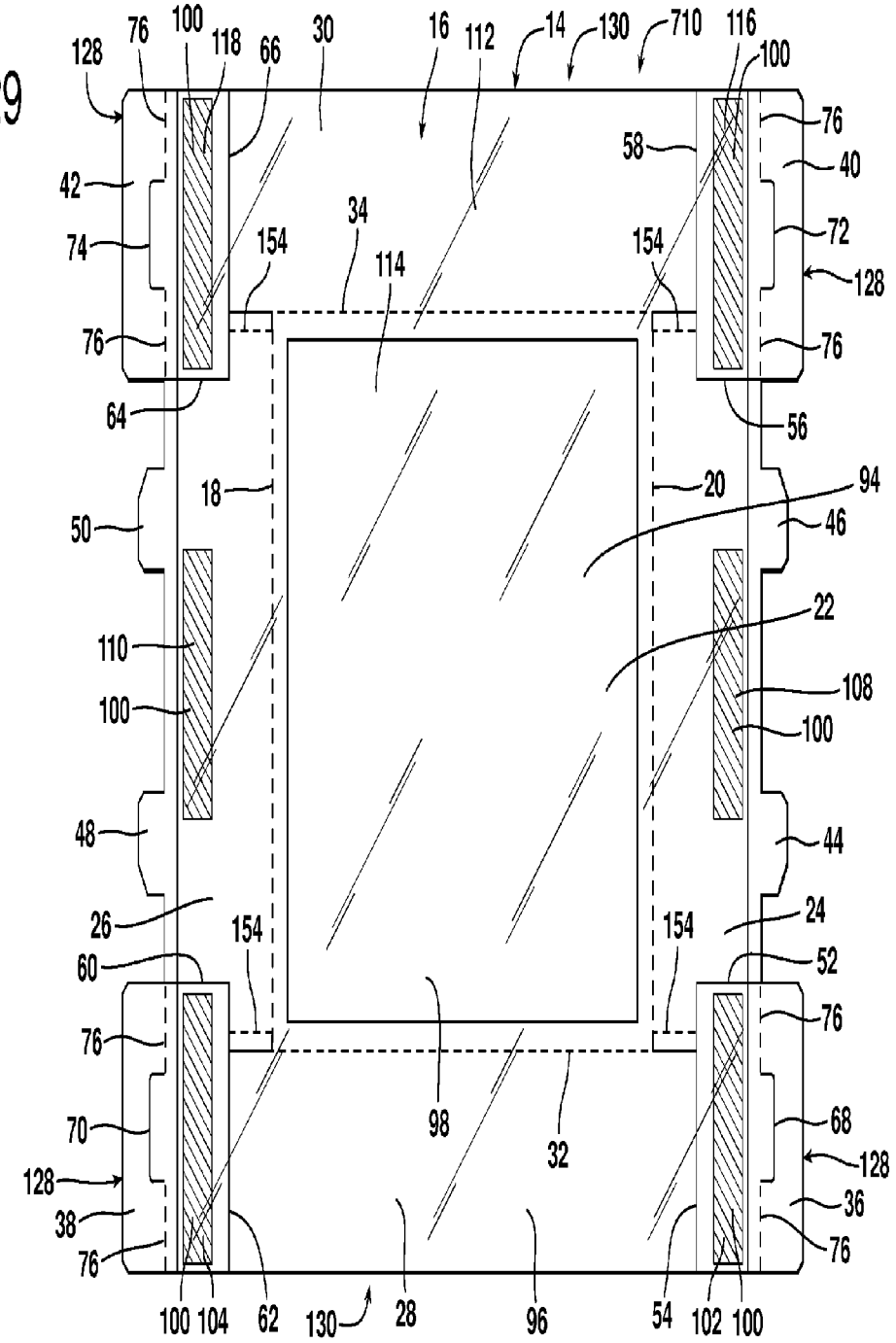
FIG. 29 is a representative top down plan view of another embodiment frame 710 in the lay-flat position 130 and defining panel opening 94.

Front remainder portion 98 extends from the front retaining portion 96 of sheet 16 and at least partially overlays the central portion 22 of panel 14. (FIGS. 2, 19.) For example, front remainder portion 98 of sheet 16 may extend over (i.e., across) the panel opening 94. (FIG. 29.) In frame 710 of FIG. 29, sheet 16 is shown completely covering panel opening 94; in other embodiments the sheet may extend over the panel opening and only partially cover the panel opening (not illustrated).

A rear remainder portion 114 may extend from the rear retaining portion 112 and at least partially overlay the central portion 22 of panel 14. (FIG. 2.) For example, rear remainder portion 114 of sheet 16 may extend over (i.e., across) the panel opening 94 of frame 710. (FIG. 29.) At least one or both of the front remainder portion 98 and rear remainder portion 114 extends across panel opening 94.

Sheet 16 may be attached to panel 14, for example to any of the portions or pieces described herein, by any of the ways described herein. As illustrated, front retaining portion 96 of sheet 16 is attached to the right front piece 36 by adhesive 100 in zone 102 and attached to the left front piece 38 by adhesive 100 in zone 104. (FIGS. 2, 19.) Rear retaining portion 112 of sheet 16 is attached to the right rear piece 40 by adhesive 100 in zone 116 and attached to the left rear piece 42 by adhesive 100 in zone 118. (FIG. 2.)

The front remainder portion 98 of sheet 16 may also be attached to panel 14 outside of the right and left front pieces 36, 38. For example, front remainder portion 98 of sheet 16 may be attached to the central portion 22 of panel 14 by adhesive 100 in zone 106. (FIGS. 2, 19.) Front remainder portion 98 may be attached to the right retention flap 24 by adhesive 100 in zone 108 and to the left retention flap 26 by adhesive 100 in zone 110. (FIG. 2.)

The rear remainder portion 114 of sheet 16 may also be attached to panel 14 outside of the right and left rear pieces 40, 42. For example, rear remainder portion 114 of sheet 16 may be attached to the central portion 22 of panel 14 by adhesive 100 in zone 120. (FIG. 2.) Rear remainder portion 114 may be attached to the right retention flap 24 by adhesive 100 in zone 108 and to the left retention flap 26 by adhesive 100 in zone 110. (FIG. 2.)

Figure 13:
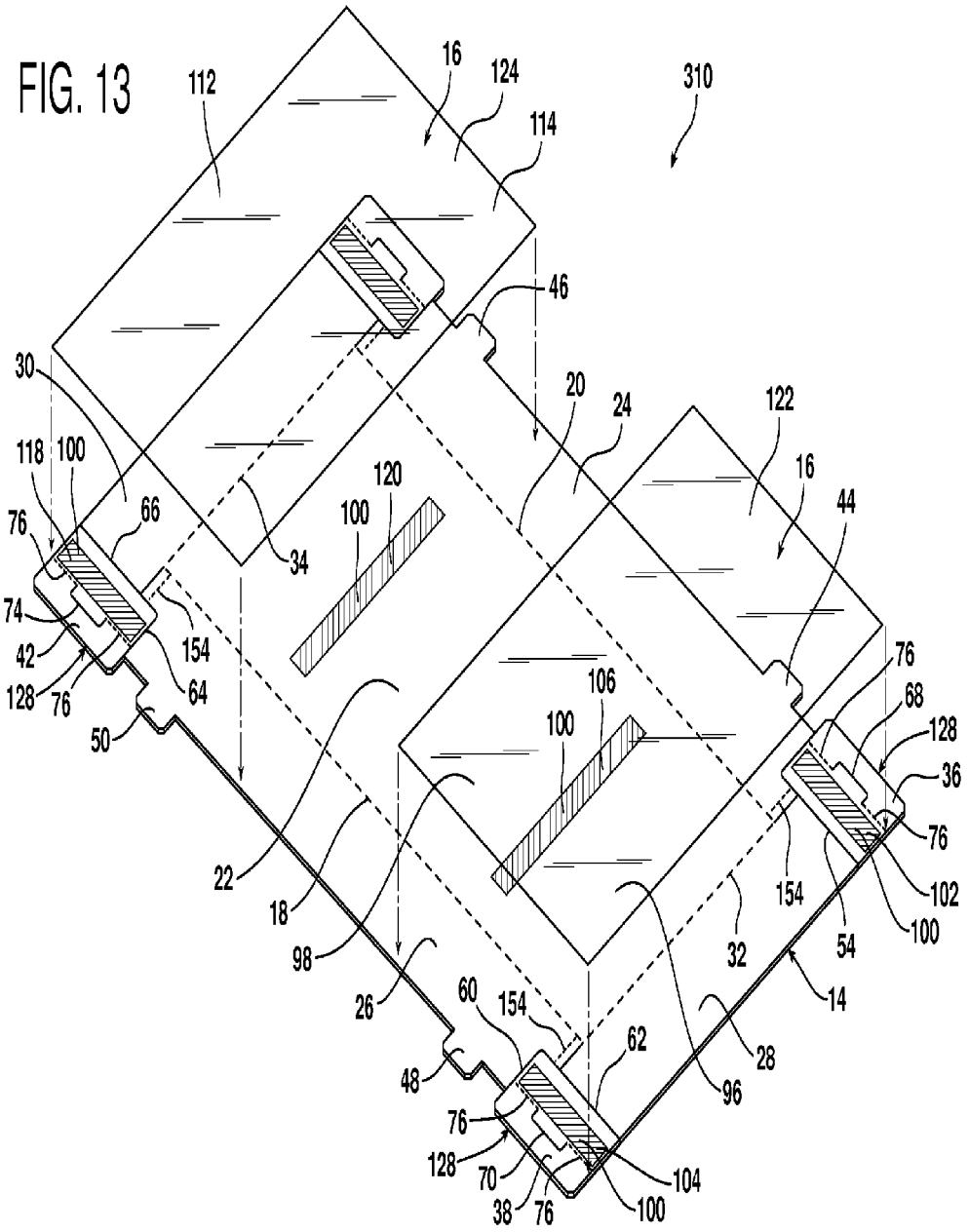
FIG. 13 is a representative exploded perspective view of another embodiment frame 310.
Figure 14:
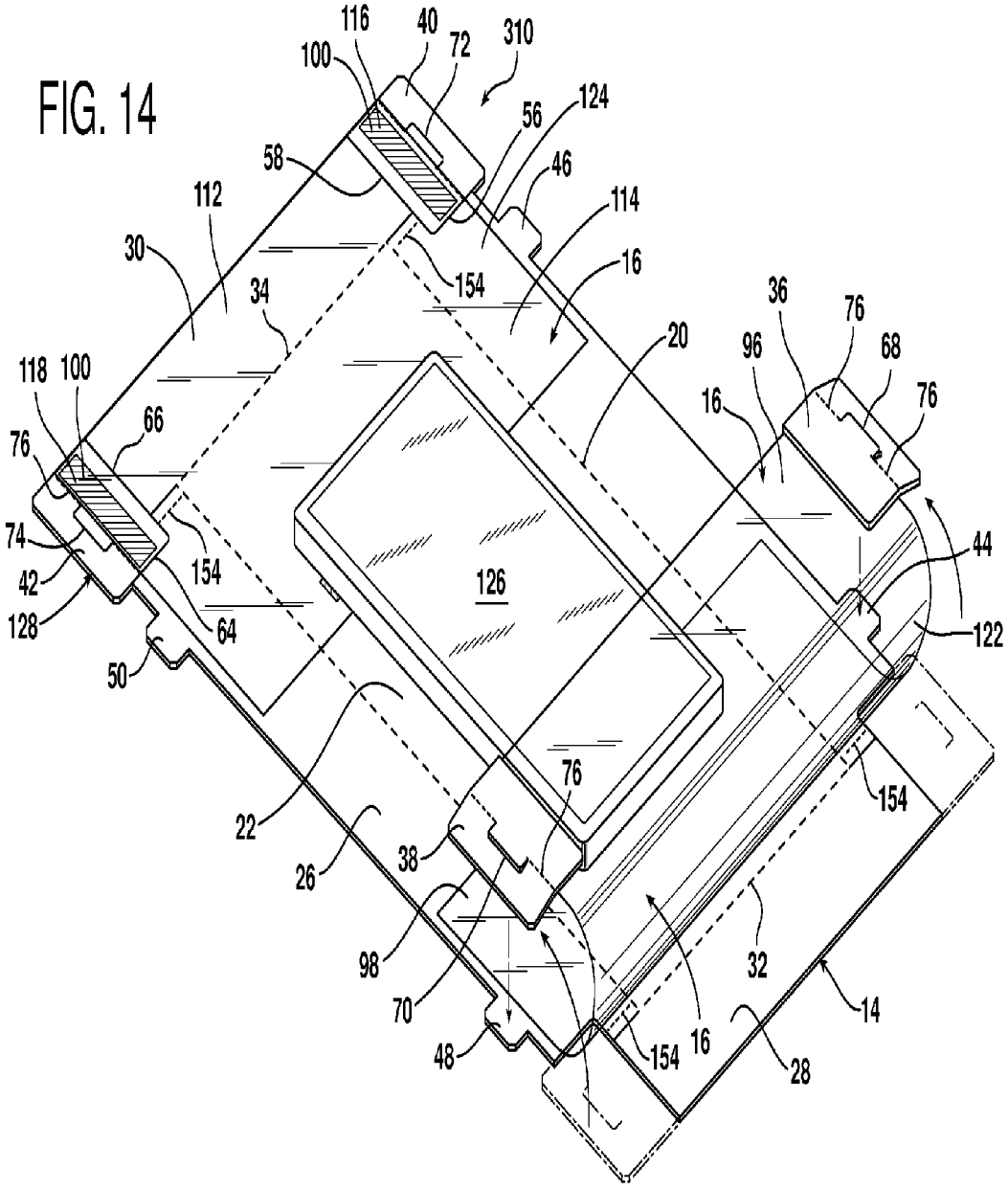
FIG. 14 is a representative perspective view of frame 310 having product 126 placed on sheet 16 in the central portion 22 of panel 14, having front right piece 36 detached from right retention flap 24 and front left piece 38 detached from left retention flap 26.

Sheet 16 may be continuous as shown with respect to frame 10 of FIGS. 1 to 7. Alternatively, sheet 16 may be discontinuous, for example, as illustrated for the embodiment frame 310 of FIGS. 13 to 14, sheet 16 may include a front section 122 and a rear section 124 as distinct pieces, such that the front section 122 includes the front retaining portion 96 and the front remainder portion 98 of sheet 16, and the rear section 122 includes rear retaining portion 112 and rear remainder portion 114 of sheet 16.

In the drawings, sheet 16 is shown attached to the panel 14 by adhering with adhesive 100 applied in various zones; however, the sheet may be attached to the panel, for example, by one or more of any of the following: adhering (e.g., with hot melt adhesive), gluing, heat welding, ultrasonic welding, stapling, tacking, taping, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the ways of attachment described herein.

Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

Sheet 16, and any of the sheets of the various embodiments described herein, may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

Sheet 16 may have a composition and thickness providing acceptable performance properties (e.g., flexibility, elasticity, optics, strength) for the given packaging application of expected use. The sheet may have a thickness of at most any of the following: 10 mils, 6 mils, 5 mils, 4 mils, 3 mils, 2 mils, 1.5 mils, and 1 mil. (A "mil" is equal to 0.001 inch.) The sheet may also have a thickness of at least any of the following: 0.5 mils, 1 mil, 1.5 mils, 2 mils, and 3 mils.

The sheet may have an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

The sheet may have a maximum load tear resistance in either or both of the transverse and longitudinal directions of at least any of the following values: 400, 450, 500, 550, and 600 grams force, measured according to ASTM D1004.

The sheet may have a slow puncture maximum load of at least any of the following values: 4, 4.5, 5, 5.5, 6, 6.5, and 7 pounds force, measured according to ASTM F1306 using a crosshead speed of 5 inches per minute.

The sheet may have a Young's modulus sufficient to withstand the expected handling and use conditions, yet may provide a "soft" feel that may be desirable for a packaging application. The sheet may have a Young's modulus of at least any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

The sheet may be transparent so that the packaged article (e.g., product 126) may be visible through the sheet. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

The sheet may have a heat-shrink attribute. For example, the sheet may have any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. Alternatively, the sheet may be non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The sheet may comprise, for example, one or more fabrics, such as one or more of the following: wovens, knits, nonwovens, and openwork meshes (e.g., netting), spandex, including Lycra® brand spandex, and elastic fabrics.

The sheet may comprise one or more polymers, for example, one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth) acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). The sheet may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

A sheet comprising polyolefin (e.g., polyethylene), polyvinyl chloride, and/or polyurethane may be useful for lightweight applications, for example, where a sheet thickness of from 2 to 4 mils may be desirable. A sheet comprising polyurethane may provide desirable elastomeric, puncture resistance, temperature resistance, and tackiness characteristics.

The sheet may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

he sheet may be manufactured by thermoplastic film-forming processes known in the art (e.g., tubular or blown-film extrusion, coextrusion, extrusion coating, flat or cast film extrusion). A combination of these processes may also be employed.

At least one side of the sheet may be corona and/or plasma treated to change the surface energy of the sheet, for example, to increase the ability of the sheet to adhere to a panel or frame.

Films that may be useful as sheets are described in U.S. Pat. No. 6,913,147 issued Jul. 5, 2005 and entitled "Packaging Structure Having a Frame and Film," which is incorporated herein in its entirety by reference.

Manufacture

By using types of machinery known to those of skill in the field, panel 14 may be cut to the desired shapes and provided with fold lines and/or lines of detachability, using the known types of machinery, for example, to slit, crease, crimp, emboss, perforate, score, or otherwise weaken the panel in desired regions. Adhesive 100 may be applied to the panel 14 in selected areas, for example, any one or more of the attachment zones 102, 104, 106, 108, 116, 118, and 120. (FIG. 2). The sheet 16 may be attached to the panel 14 by laminating or adhering the sheet with adhesive 100 to the panel, or by other ways as discussed herein. The sheet material may be provided in roll form, unrolled, and then cut to the desired length and width either before or after attachment to the panel.

Use

Frame 10 may be provided in the lay-flat position 130 as shown in FIG. 2 having the right and left front pieces 36, 38, and if present, the right and left rear pieces 40, 42, in the initial position, and the right and left retention flaps 24, 26 generally coplanar with central portion 22, as shown in FIGS. 2, 4, 15, 19, 20, 22, and 29. Such position may facilitate the provision of multiple frames in a convenient stacked or bundled arrangement (not illustrated).

A product to be packaged, for example product 126, may be placed on the front remainder portion 98 of the sheet 16 in the central portion 22 of the panel 14. In the embodiments also having rear retaining portion 112 of sheet 16, the product may also be placed on the rear remainder portion 114 of sheet 16 in the central portion 22 of panel 14. (See FIGS. 1, 4, 5-11, 14, 18, and 21.)

The right retention flap 24 may be folded along the right fold line 20 to extend above the plane of the central portion 22. The left retention flap 26 may be folded along the left fold line 18 to extend above the plane of the central portion 22. (See, e.g., FIG. 6.) "Above" the plane of the central portion is taken relative the side of the central portion 22 having sheet 16, on which a product will reside; and "beneath" the central portion is taken relative the side of the central portion opposite the side of the central portion 22 having sheet 16 on which a product will reside. Accordingly, "above" and "beneath" in this context do not change if the frame is turned "upside-down."

Folding the right and left retention flaps to extend above the plane of the central portion may facilitate the ease with which the right and left front pieces 36, 38 may be moved to the engaged position 132 (discussed below), and if present, the ease with which the right and left rear pieces 40, 42 may be moved to the engaged position 132 (discussed below), by providing slack in sheet 16.

Right front piece 36 is moveable from the initial position 128 (FIGS. 2, 15, 19-20, 22, 29) to an engaged position 132 (FIG. 6, 17-18) where the right front piece 36 is coupled with the right retention flap 24. The right front piece 36 in the engaged position 128 connects the front retaining portion 96 of sheet 16 to the right retention flap 24. Left front piece 38 is moveable from the initial position 128 (FIGS. 2, 15, 19-20, 22, 29) to an engaged position 132 (FIGS. 6, 18, 21*a*) where the left front piece 38 is coupled with the left retention flap 26. The left front piece 38 in the engaged position 128 connects the front retaining portion 96 of sheet 16 to the left retention flap 26. Right rear piece 40 is moveable from the initial position 128 (FIG. 2, 15, 20, 22, 29) to an engaged position 132 (FIGS. 6, 17-18) where the right rear piece 40 is coupled with the right retention flap 24. The right rear piece 40 in the engaged position 128 connects the rear retaining portion 112 of sheet 16 to the right retention flap 24. Left rear piece 42 is moveable from the initial position 128 (FIG. 2, 15, 20, 22, 29) to an engaged position 132 (FIG. 6, 18, 21*a*) where the left rear piece 36 is coupled with the left retention flap 26. The left rear piece 42 in the engaged position 128 connects the rear retaining portion 112 of sheet 16 to the left retention flap 26.

When the right and left front pieces 36, 38 are both in their engaged positions 128, the front retaining portion 96 of sheet 16 extends over both the central portion 22 of panel 14 and the front remainder portion 98 of sheet 16. Accordingly, moving the right and left front pieces 36, 38 from their initial positions 128 to their engaged positions 132 extends the front retaining portion 98 of the sheet 16 over the product 126 placed as described above on sheet 16. For the embodiments also having a rear retaining portion 112 of sheet 16, when the right and left rear pieces 40, 42 are both in their engaged positions 128, the rear retaining portion 112 of sheet 16 extends over both the central portion 22 of panel 14 and the rear remainder portion 114 of sheet 16. Accordingly, moving the right and left rear pieces 40, 42 from their initial positions 128 to their engaged positions 132 extends the rear retaining portion 114 of sheet 16 over the product 126 placed as described above on sheet 16.

The frame is positionable in an intermediate position 134 (FIGS. 6, 8, 17, 18) in which the right retention flap 24 is folded along the right fold line 20 to extend above the plane of the central portion 22, the left retention flap 26 is folded along the left fold line 18 to extend above the plane of the central portion 22, the right and left front pieces 36, 38 are in the engaged position 132, and if present, the right and left rear pieces 40, 42 are in the engaged position 132.

Figure 5:
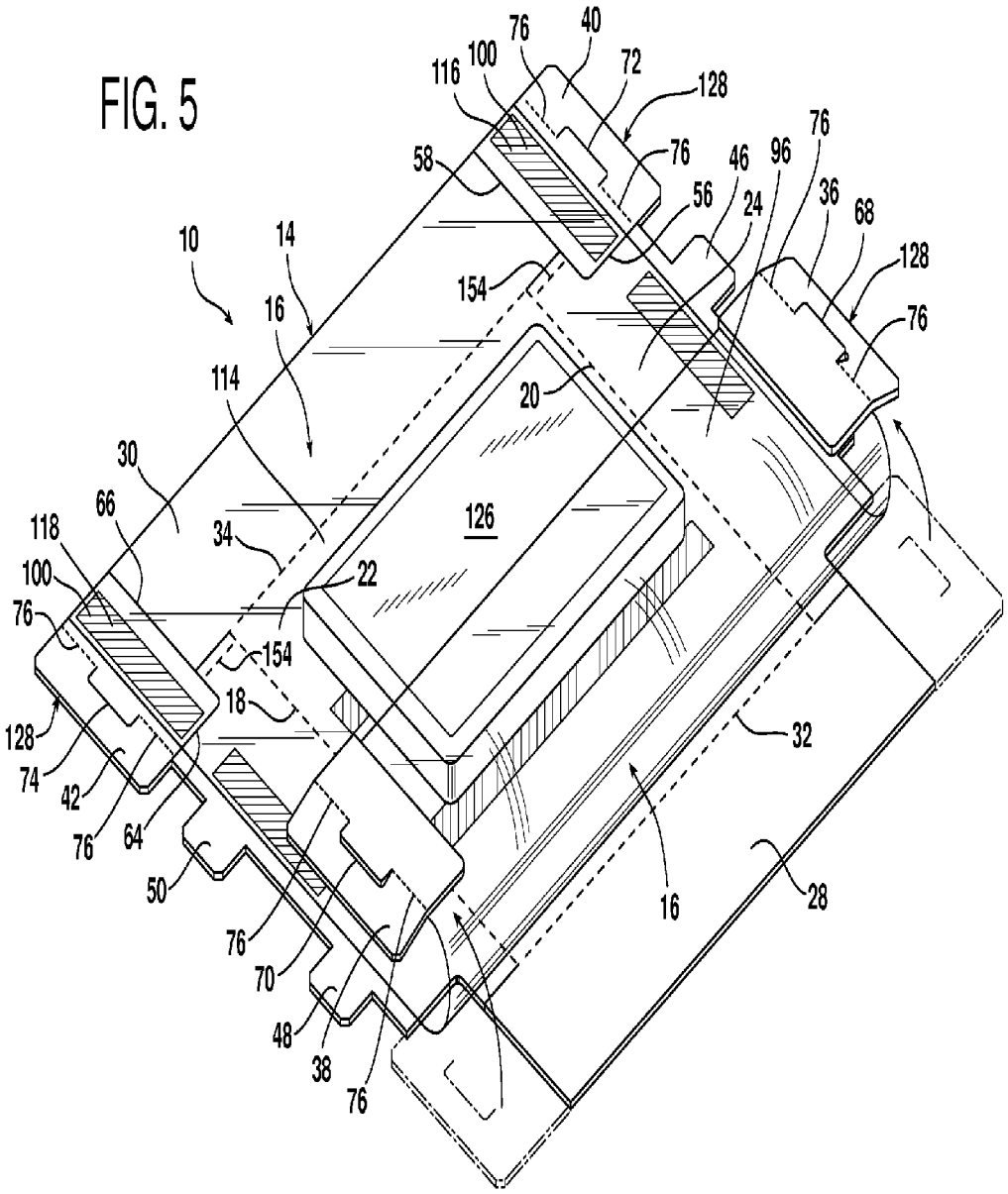
FIG. 5 is a representative perspective view of the frame 10 similar to FIG. 4, but having front right piece 36 detached from right retention flap 24 and front left piece 38 detached from left retention flap 26.
Figure 6:
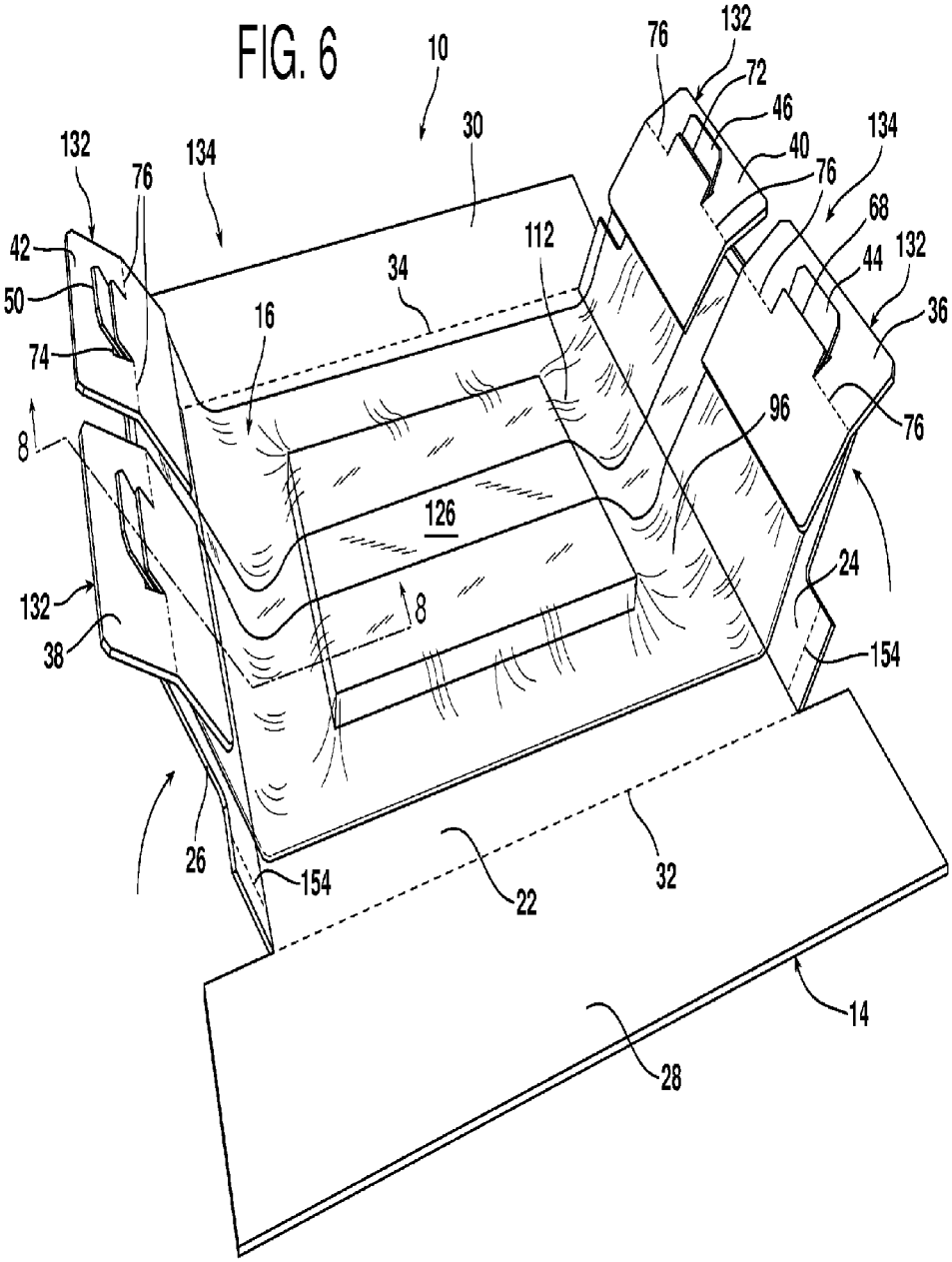
FIG. 6 is a representative perspective view of frame 10 in the intermediate position 134 having pieces 36, 38, 40, 42 in the engaged position 132.
Figure 7:
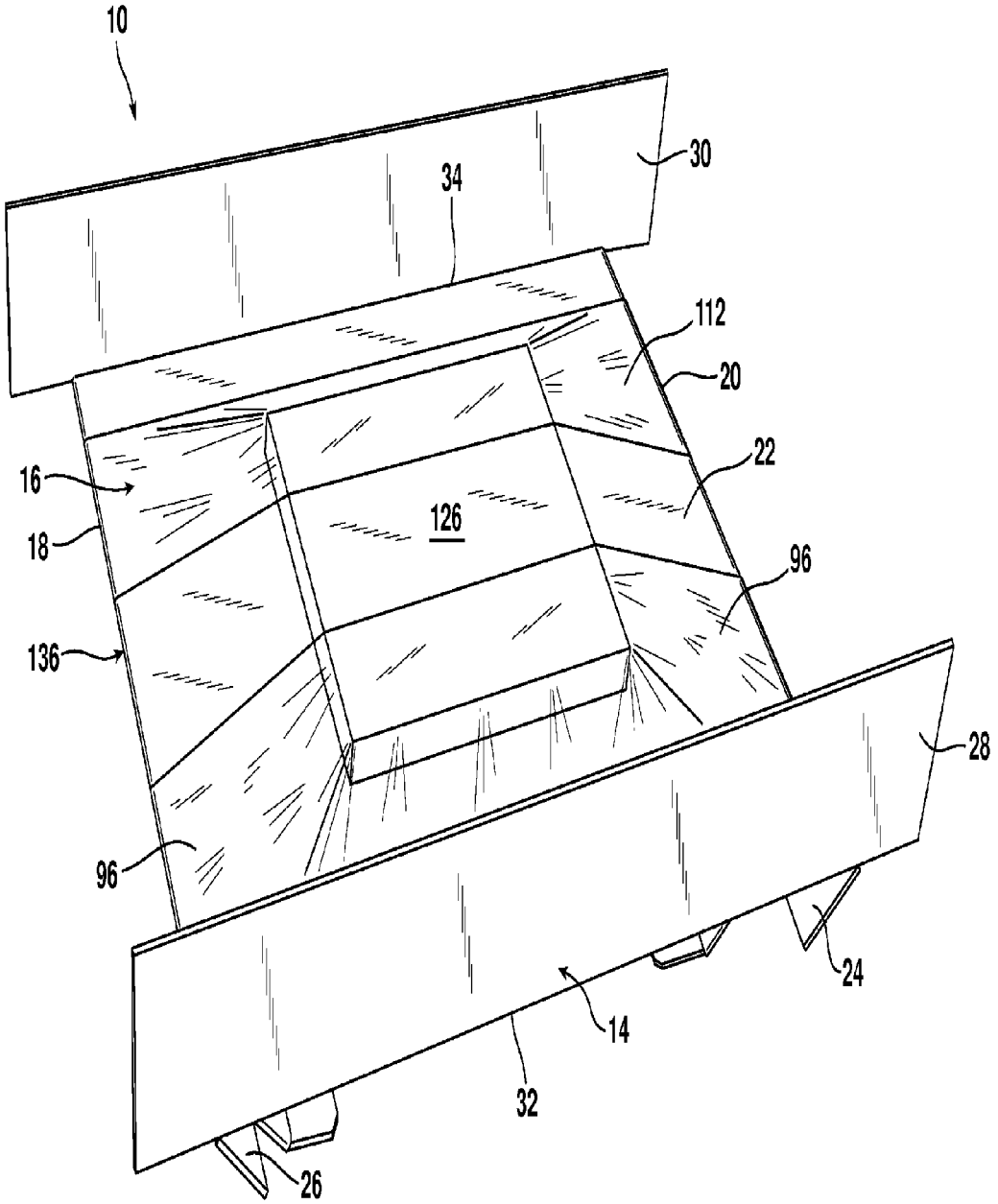
FIG. 7 is a representative perspective view of frame 10 in the retained position 136.

There are several ways to couple the right front piece 36 with the right retention flap 24 to place right front piece in the engaged position 132. For example, right front piece 36 may be detached from the right retention flap 24 along detachment line 52 and detached from the front flap along detachment line 54. (FIGS. 5, 21.) The right retention flap 24 may be folded along the right fold line 20 to extend above the plane of the central portion 22 to provide some slack in sheet 16. (FIG. 6.) The right front piece 36 may be folded slightly along the slot fold lines 76 to open the slot 68. The right front piece 36 is coupled with the right retention flap 24 by inserting the right front tab 44 of the right retention flap 24 to extend through the slot 68 of the right front piece 36. (FIG. 6.) As a result, the front retaining portion 96 of sheet 16, which is attached to the right front piece 36, is also connected to the right retention flap 24.

Figure 8:
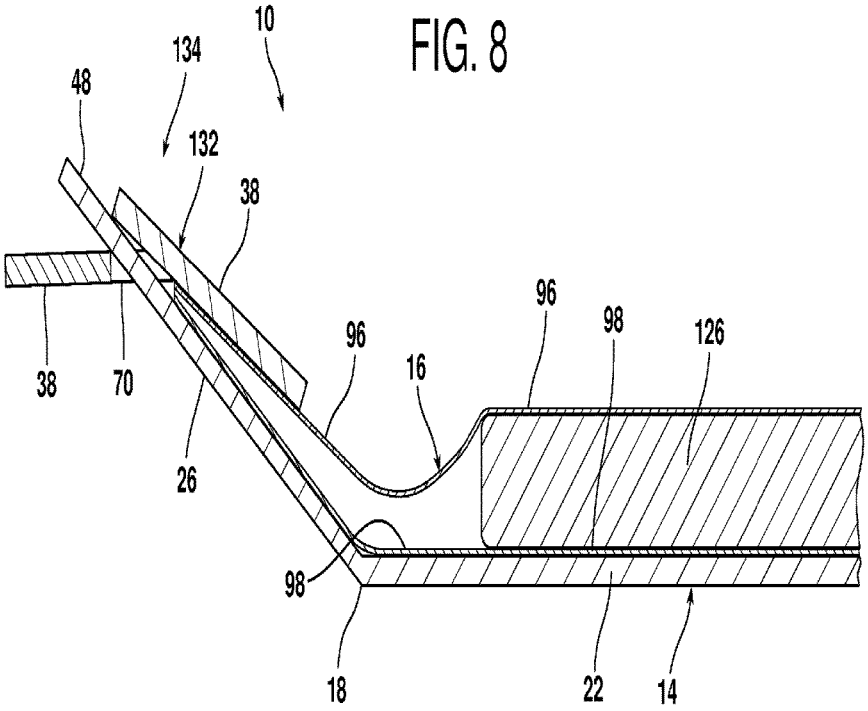
FIG. 8 is a representative section view taken along the line 8-8 of FIG. 7 showing left front piece 38 in the engaged position 132 and frame 10 in the intermediate position 134.
Figure 9:
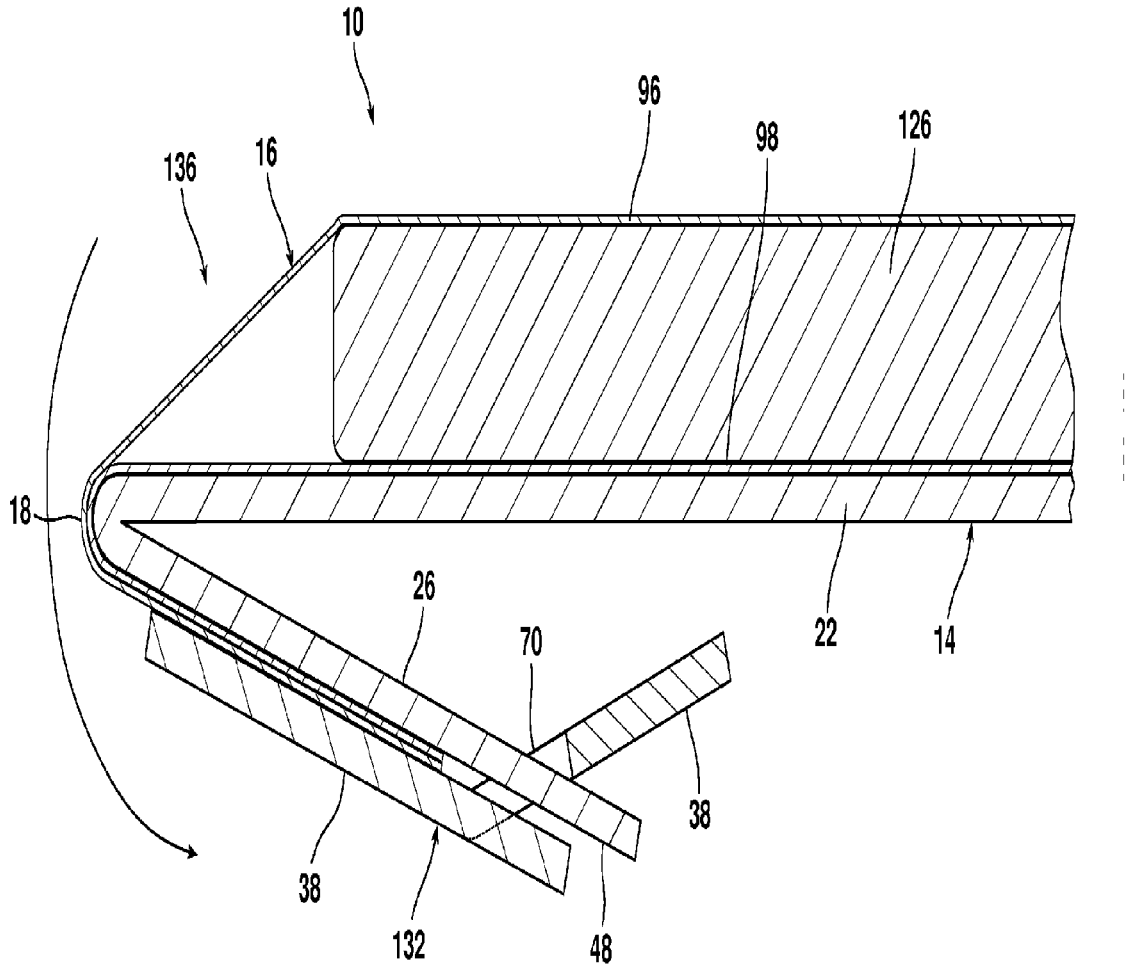
FIG. 9 is a representative section view similar to that of FIG. 8, but having frame 10 positioned in the retained position 136 to retain product 126 between the front retaining portion 96 and front remainder portion 98 of sheet 16.

In similar manner, the left front piece 38 may be coupled with the left retention flap 26 to place left front piece in the engaged position 132. Left front piece 38 may be detached from the left retention flap 26 along detachment line 60 and detached from the front flap along detachment line 62. (FIGS. 5, 21.) The left retention flap 26 may be folded along the left fold line 18 to extend above the plane of the central portion 22 to provide some slack in sheet 16. (FIG. 6.) The left front piece 38 may be folded slightly along the slot fold lines 76 to open the slot 70. The left front piece 38 is coupled with the left retention flap 26 by inserting the left front tab 48 of the left retention flap 26 to extend through the slot 70 of the left front piece 38. (FIGS. 6, 8.) As a result, the front retaining portion 96 of sheet 16, which is attached to the left front piece 38, is also connected to the left retention flap 26.

For the embodiments having right and left rear pieces 40, 42, these pieces may be coupled with the retention flaps for placement in the engaged position 132 in a similar manner as discussed in the previous two paragraphs. In more detail, right rear piece 40 may be detached from the right retention flap 24 along detachment line 56 and detached from the rear flap along detachment line 58. (FIGS. 2, 20, 21.) The right retention flap 24 may be folded along the right fold line 20 to extend above the plane of the central portion 22 to provide some slack in sheet 16. The right rear piece 40 may be folded slightly along the slot fold lines 76 to open the slot 72. The right rear piece 40 is coupled with the right retention flap 24 by inserting the right rear tab 46 of the right retention flap 24 to extend through the slot 72 of the right rear piece 40 (FIG. 6)—or for the frame 510 embodiment of FIGS. 20-21*a*, by inserting the right front tab 44 of the right retention flap 24 to extend through the slot 72 of the right rear piece 40, so that the tab 44 extends through both the slots 68, 72. As a result, the rear retaining portion 112 of sheet 16, which is attached to the right rear piece 40, is also connected to the right retention flap 24.

Continuing with the detail, left rear piece 42 may be detached from the left retention flap 26 along detachment line 64 and detached from the rear flap along detachment line 66. (FIGS. 2, 20, 21.) The left retention flap 26 may be folded along the left fold line 18 to extend above the plane of the central portion 22 to provide some slack in sheet 16. The left rear piece 42 may be folded slightly along the slot fold lines 76 to open the slot 74. The left rear piece 42 is coupled with the left retention flap 26 by inserting the left rear tab 50 of the left retention flap 26 to extend through the slot 74 of the left rear piece 42 (FIG. 6)—or for the frame 510 embodiment of FIGS. 20-21*a*, by inserting the left front tab 48 of the left retention flap 26 to extend through the slot 74 of the left rear piece 42, so that the tab 48 extends through both the slots 70, 74. (FIG. 21*a*.) As a result, the rear retaining portion 112 of sheet 16, which is attached to the left rear piece 42, is also connected to the left retention flap 26.

Figure 15:
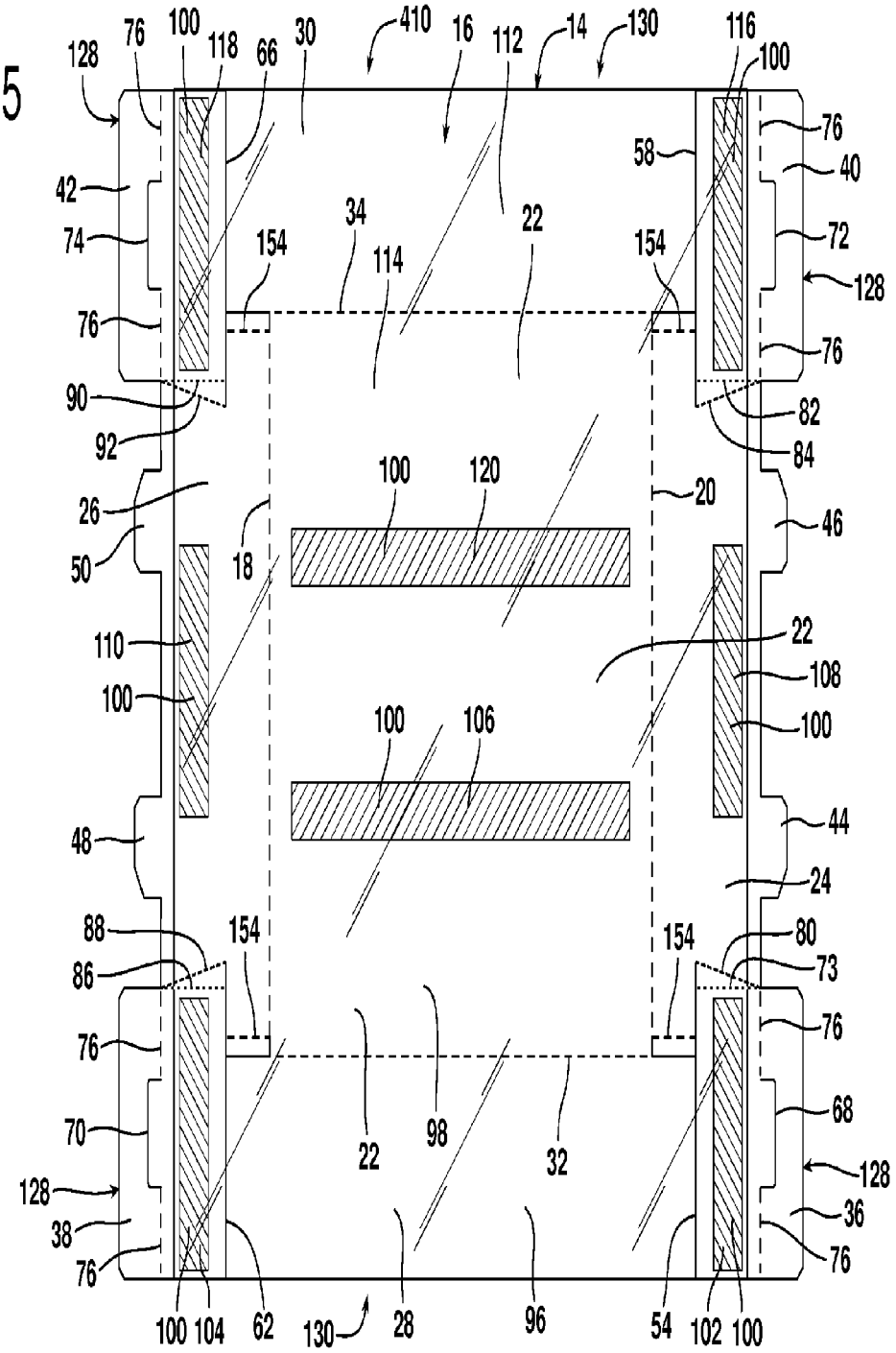
FIG. 15 is a representative top down plan view of another embodiment frame 410 in the lay-flat position 130.
Figure 16:
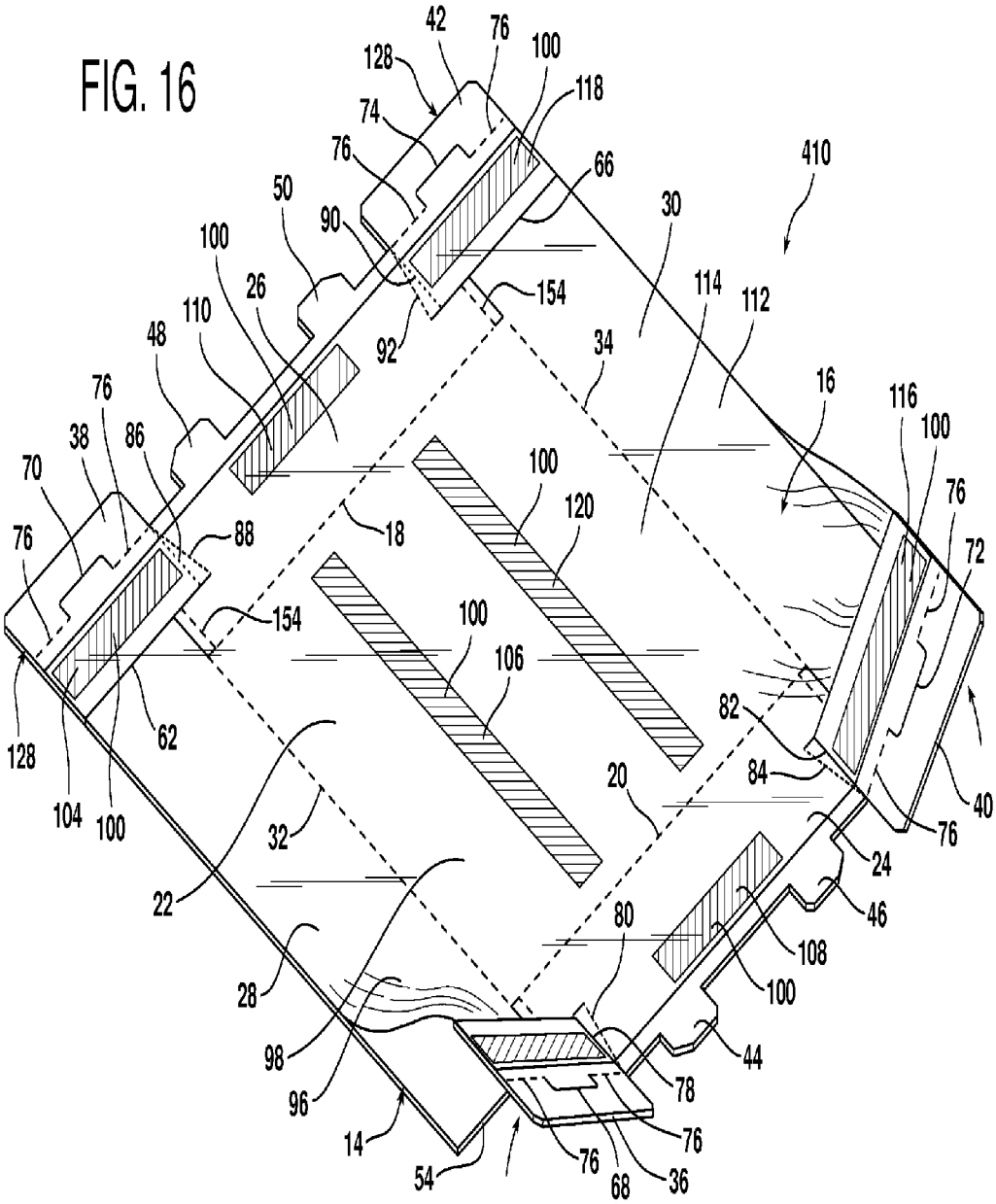
FIG. 16 is a representative perspective view of frame 410 having right front piece 36 detached from front flap 28 and folded along primary fold line 78 and right rear flap 40 detached from rear flap 30 and folded along primary fold line 82.
Figure 17:
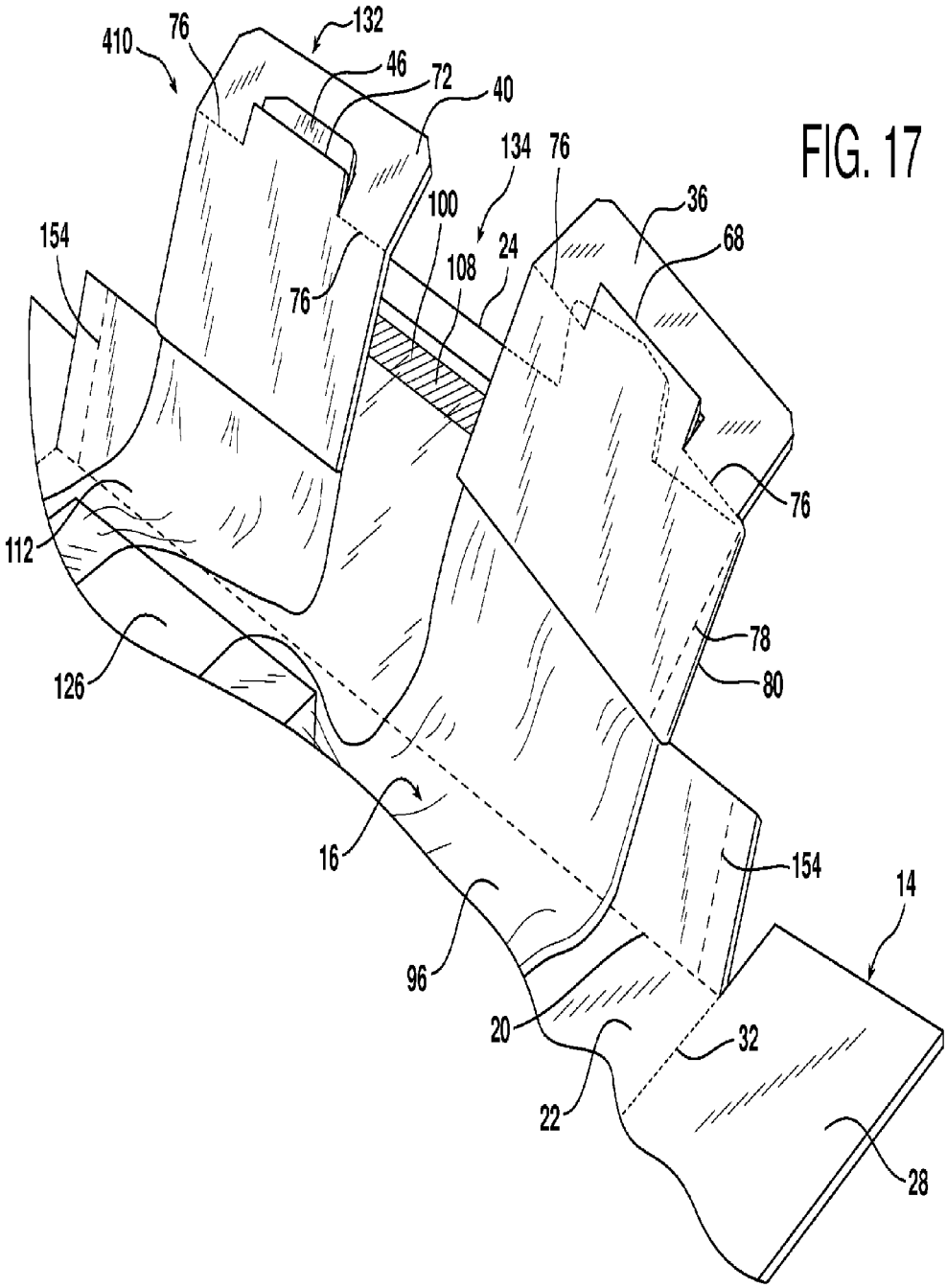
FIG. 17 is a perspective detail view of a the right rear piece 40 and right front piece 36 of FIG. 18.
Figure 18:
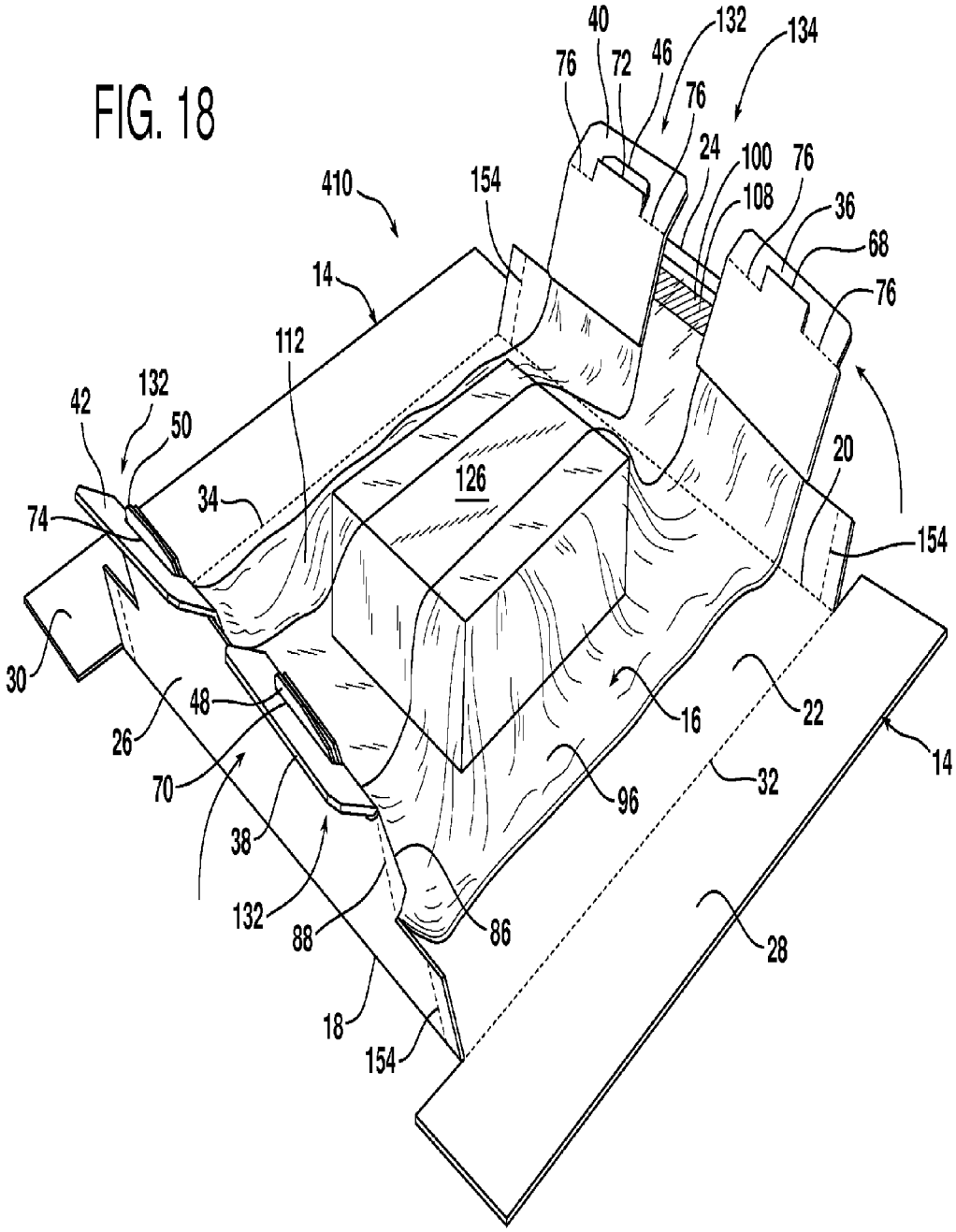
FIG. 18 is a perspective view of frame 410 in the intermediate position 134, having pieces 38, 40, 42 in the engaged position 132, and right front piece 36 midway in movement to the engaged position.

For the embodiment frame 410 illustrated in FIGS. 15 to 18, the pieces 36, 38, 40, 42 may be coupled with the corresponding retention flaps to place the pieces in the engaged position 132 as follows. Right front piece 36 is detached from the front flap along detachment line 54 and is folded along primary fold line 78. (FIG. 16.) The right retention flap 24 is folded along the right fold line 20 to extend above the plane of the central portion 22. (FIG. 17.) The right front piece 36 may be folded slightly along the slot fold lines 76 to open slot 68. The right front piece 36 is folded along supplemental fold line 80 so that right front piece 36 is offset slightly relative the right retention flap 24 to facilitate the next step. The right front piece 36 is coupled with the right retention flap 24 by inserting the right front tab 44 of the right retention flap 24 to extend through the slot 68 of the right front piece 36. (FIGS. 17-18.) As a result, the front retaining portion 96 of sheet 16, which is attached to the right front piece 36, is also connected to the right retention flap 24.

In similar manner, left front piece 38 is detached from the front flap along detachment line 62 and is folded along primary fold line 86. (FIGS. 15-16.) The left retention flap 26 is folded along the left fold line 18 to extend above the plane of the central portion 22. (FIG. 18.) The left front piece 38 may be folded slightly along the slot fold lines 76 to open slot 70. The left front piece 38 is folded along supplemental fold line 88 so that left front piece 38 is offset slightly relative the left retention flap 26 to facilitate the next step. The left front piece 38 is coupled with the left retention flap 26 by inserting the left front tab 48 of the left retention flap 26 to extend through the slot 70 of the left front piece 38. (FIG. 18.) As a result, the front retaining portion 96 of sheet 16, which is attached to the left front piece 38, is also connected to the left retention flap 26.

For embodiments having right and left rear pieces 40, 42, these pieces may be coupled with the retention flaps for placement in the engaged position 132 in a similar manner as discussed in the previous two paragraphs. In more detail, right rear piece 40 is detached from the rear flap along detachment line 58 and is folded along primary fold line 82. (FIG. 16.) The right retention flap 24 is folded along the right fold line 20 to extend above the plane of the central portion 22. (FIG. 17.) The right rear piece 40 may be folded slightly along the slot fold lines 76 to open slot 68. The right rear piece 40 is folded along supplemental fold line 84 so that right rear piece 40 is offset slightly relative the right retention flap 24 to facilitate the next step. The right rear piece 40 is coupled with the right retention flap 24 by inserting the right rear tab 46 of the right retention flap 24 to extend through the slot 72 of the right rear piece 40. (FIGS. 17-18.) As a result, the rear retaining portion 112 of sheet 16, which is attached to right rear piece 40, is also connected to the right retention flap 24.

Continuing with the detail, left rear piece 42 is detached from the rear flap along detachment line 66 and is folded along primary fold line 90. (FIGS. 15-16.) The left retention flap 26 is folded along the left fold line 18 to extend above the plane of the central portion 22. (FIG. 18.) The left rear piece 42 may be folded slightly along the slot fold lines 76 to open slot 74. The left rear piece 42 is folded along supplemental fold line 92 so that left rear piece 42 is offset slightly relative the left retention flap 26 to facilitate the next step. The left rear piece 42 is coupled with the left retention flap 26 by inserting the left rear tab 50 of the left retention flap 26 to extend through the slot 74 of the left rear piece 42. (FIG. 18.) As a result, the rear retaining portion 112 of sheet 16, which is attached to left rear piece 42, is also connected to the left retention flap 26.

Another way of coupling any of the right front, left front, right rear, and left rear pieces with their respective retention flap to place the piece in the engaged position 132 is described here in reference to FIG. 23. FIG. 23 shows exemplary right rear piece 240 having adhesive 100 in zone 140. In use, the releasable liner 138 is removed to expose the adhesive 100 (e.g., a pressure sensitive adhesive) in zone 140. The piece 240 is moved from the initial position shown in FIG. 23 to an engaged position (not illustrated) in which the adhesive adheres the piece to the retention flap thereby coupling the piece to the retention flap to connect a retaining portion of the sheet to the retention flap.

Another way of coupling any of the right front, left front, right rear, and left rear pieces with their respective retention flap to place the piece in the engaged position 132 is described here in reference to FIG. 24. FIG. 24 shows exemplary right rear piece 340 having protuberance 142. In use, the piece 340 is moved from the initial position shown in FIG. 24 to an engaged position (not illustrated) in which protuberance 142 is inserted through the corresponding slot 144 in the retention flap thereby coupling the piece to the retention flap to connect a retaining portion of the sheet to the retention flap.

Still another way of coupling any of the right front, left front, right rear, and left rear pieces with their respective retention flap to place the piece in the engaged position 132 is described here in reference to FIGS. 25 to 26. FIGS. 25, 26 show exemplary right rear piece 440 having sleeve 146 with sleeve opening 147 formed by front portion 148 and back portion 150. In use, the piece 440 is moved from the initial position shown in FIG. 25 to an engaged position (not illustrated) in which the sleeve 146 is inserted on right rear tab 46 so that right rear tab 46 inserts in opening 147 between the front and back portions 148, 150 thereby coupling the piece to the retention flap to connect a retaining portion of the sheet to the retention flap.

Yet another way of coupling any of the right front, left front, right rear, and left rear pieces with their respective retention flap to place the piece in the engaged position 132 is described here in reference to FIGS. 27 to 28. FIGS. 27 to 28 show exemplary right rear piece 540 having adhesive 100 in left zone 148 and right zone 150 attaching sheet 16 to the right rear piece leaving an unattached gap where sheet 16 defines slot 152. In use, the piece 540 is moved from the initial position shown in FIG. 27 to an engaged position (FIG. 28) in which right rear tab 46 is inserted through slot 152 of sheet 16 thereby coupling the piece to the retention flap to connect a retaining portion of the sheet to the retention flap.

Figure 22:
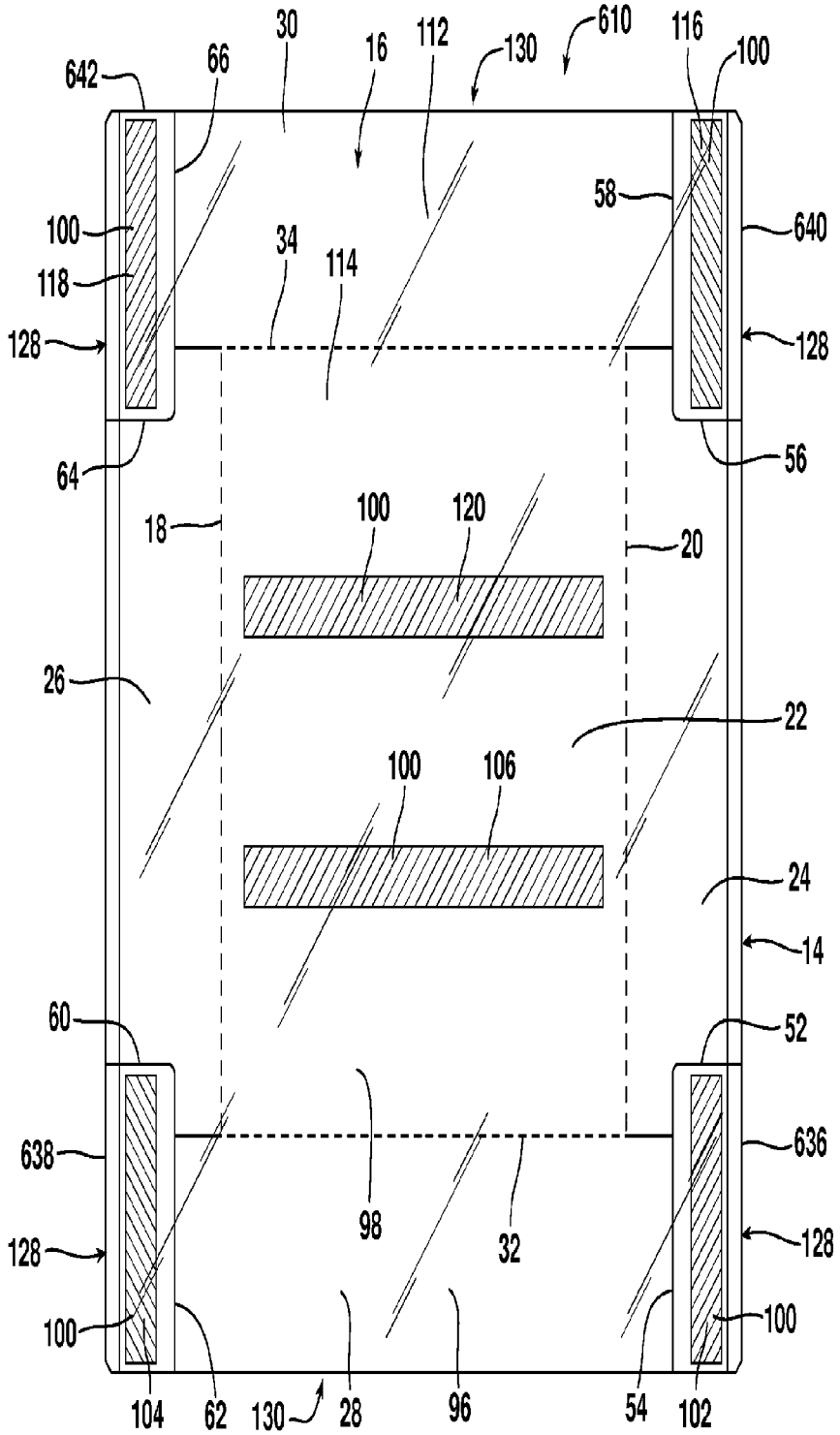
FIG. 22 is a representative top down plan view of another embodiment frame 610 in the lay-flat position 130.

Other ways of coupling any of the right front, left front, right rear, and left rear pieces with their respective retention flap to place the piece in the engaged position 132 include moving the piece from the initial position, for example with reference to embodiment frame 610 of FIG. 22, moving any of right front piece 636, left front piece 638, right rear piece 640, and left rear piece 642 from the initial position 128 to an engaged position in which the piece is juxtaposed with and coupled to a retention flap by one or more of any of the following: adhering (e.g., gluing with hot melt adhesive), welding (e.g., heat welding and ultrasonic welding) stapling, tacking, taping, clipping, anchoring, and fastening (e.g., using a hook-and-loop fastening system such as Velcro brand) (not illustrated). This results in a retaining portion of the sheet connecting to the retention flap. The ways of coupling that comprise securing (e.g., via tab/slot engagement and tab/sleeve engagement) have been discussed above with respect to other embodiments.

The frame is positionable in a retained position 136 (FIGS. 1, 7, 9-12) in which the right and left front pieces are in their engaged positions 132, and if present the right and left rear pieces 40, 42 are in their engaged positions 132, the right retention flap 24 is folded along the right fold line 20 to extend the right retention flap beneath the central portion 22 of panel 14, and the left retention flap 26 is folded along the left fold line 18 to extend the left retention flap beneath the central portion 22 of panel 14. In positioning the frame to the retained position 136, the front retaining portion 96 of sheet 16, and if present the rear retaining portion 112 of sheet 16, are tensioned to retain product 126 between the front retaining portion 96 and front remainder portion 98 of sheet 16, and if present, also to retain product 126 between the rear retaining portion 112 and the rear remainder portion 114 of sheet 16.

If front flap 28 and rear flap 30 are present, then front flap 28 and rear flap 30 may be folded along front fold line 32 and along rear fold line 34, respectively, to extend above the plane of the central portion. (FIGS. 1, 7, 10-11.)

In use, the frame may be positioned in the intermediate position 134 before positioning the frame in the retained position 136.

The frame positioned in the retained position (e.g., to retain product 126 between the front retaining portion 96 and front remainder portion 98 of sheet 16, and if present, also to retain product 126 between the rear retaining portion 112 and the rear remainder portion 114 of sheet 16) may be placed in box 12 to enclose the frame in the retained position within the box. (FIGS. 1, 10-11.) If two frames are used to retain a product, for example, two of frames 210 (FIG. 19) in the retained position on either end of a product to be packaged (not illustrated), then a box may enclose both frames in the retained position in the box. If front flap 28 and rear flap 30 are present, then front flap 28 and rear flap 30 may be folded along front fold line 32 and along rear fold line 34, respectively, to extend above the plane of the central portion before placement in box 12.

Box 12 may have interior dimensions corresponding with the frame 10 in the retained position (and front and rear flaps extending upwardly), as illustrated in FIG. 1. The frame 10 is placed in the retained position to retain product 126 and placed within box 12, which when closed may retain frame 10 in the retained position within box 12. Box 12 as illustrated comprises a polyhedron-shaped storage compartment, in which the side panels, bottom, and closure flaps are polygon-shaped (e.g., rectangular). Useful box types are known to those of skill in the field, and include containers of the RSC (regular slotted container) type, RELF (roll end lock front) type, RETT (roll and end tuck top) type, and STE (standard tuck end) type.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of preferred embodiments of the invention. Various alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A frame useful for retaining a product, the frame comprising:

(1) a panel comprising:

left and right opposing fold lines delineating a central portion between the left and right fold lines;

a right retention flap extending from the right fold line;

a left retention flap extending from the left fold line;

a right front piece moveable from an initial position proximal to and generally coplanar with the right retention flap to an engaged position coupled with the right retention flap; and a left front piece moveable from an initial position proximal to and generally coplanar with the left retention flap to an engaged position coupled with the left retention flap; and (2) a sheet comprising:

a front retaining portion extending between and attached to the right front piece and the left front piece; and a front remainder portion extending from the front retaining portion and at least partially overlaying the central portion of the panel, wherein:

the right front piece in the engaged position connects the front retaining portion of the sheet to the right retention flap;

the left front piece in the engaged position connects the front retaining portion of the sheet to the left retention flap;

when the right and left front pieces are both in their engaged positions, the front retaining portion of the sheet extends over both the central portion of the panel and the front remainder portion of the sheet; and the frame is positionable in a retained position having:

the right and left front pieces in their respective engaged positions;

the right retention flap folded along the right fold line to extend beneath the central portion; and the left retention flap folded along the left fold line to extend beneath the central portion, whereby the front retaining portion of the sheet is tensioned to retain a product between the front retaining portion and the front remainder portion of the sheet.

2. The frame of claim 1 wherein the frame is positionable in a lay-flat position having the right and left front pieces in the initial position and the right and left retention flaps generally coplanar with the central portion.

3. The frame of claim 1 wherein the frame is positionable in an intermediate position having:

the right retention flap folded along the right fold line to extend above the plane of the central portion;

the left retention flap folded along the left fold line to extend above the plane of the central portion;

the right front piece is in the engaged position; and the left front piece is in the engaged position.

4. The frame of claim 1 wherein the front remainder portion of the sheet is attached to the panel outside of the left and right front pieces.

5. The frame of claim 4 wherein the front remainder portion of the sheet is attached to the right and left retention flaps.

6. The frame of claim 1 wherein:

the right front piece in the initial position is detachably connected to the right retention flap; and the left front piece in the initial position is detachably connected to the left retention flap.

7. The frame of claim 1 wherein:

the right front piece is foldably connected to the right retention flap; and the left front piece is foldably connected to the left retention flap.

8. The frame of claim 1 wherein:

the right retention flap comprises a right front tab protruding opposite the right fold line;

the right front piece defines a slot for receiving the right front tab;

in the engaged position of the right front piece, the right front tab extends through the slot of the right front piece to couple the right front piece with the right retention flap;

the left retention flap comprises a left front tab protruding opposite the left fold line;

the left front piece defines a slot for receiving the left front tab; and in the engaged position of the left front piece, the left front tab extends through the slot of the left front piece to couple the left front piece with the left retention flap.

9. The frame of claim 1 wherein:

the panel further comprises:

a right rear piece opposite the right front piece and moveable from an initial position proximal to and generally coplanar with the right retention flap to an engaged position coupled with the right retention flap;

a left rear piece opposite the left front piece and moveable from an initial position proximal to and generally coplanar with the left retention flap to an engaged position coupled with the left retention flap; and the sheet further comprises:

a rear retaining portion extending between and attached to the right rear piece and the left rear piece; and a rear remainder portion extending from the rear retaining portion and at least partially overlaying the central portion of the panel, wherein:

the right rear piece in the engaged position connects the rear retaining portion of the sheet to the right retention flap;

the left rear piece in the engaged position connects the rear retaining portion of the sheet to the left retention flap;

when the right and left rear pieces are both in their engaged positions, the rear retaining portion of the sheet extends over both the central portion of the panel and the rear remainder portion of the sheet; and the retained position of the frame further comprises the right and left rear pieces in their respective engaged positions, whereby the rear retaining portion of the sheet is tensioned to retain the product between the rear retaining portion and the rear remainder portion of the sheet.

10. The frame of claim 9 wherein the frame is positionable in a lay-flat position having:

the right and left front pieces in the initial position;

the right and left rear pieces in the initial position; and the right and left retention flaps generally coplanar with the central portion.

11. The frame of claim 9 wherein the frame is positionable in an intermediate position having:

the right retention flap folded along the right fold line to extend above the plane of the central portion;

the left retention flap folded along the left fold line to extend above the plane of the central portion;

the right front piece is in the engaged position;

the left front piece is in the engaged position;

the right rear piece is in the engaged position; and the left rear piece is in the engaged position.

12. The frame of claim 9 wherein the rear remainder portion of the sheet is attached to the panel outside of the left and right rear pieces.

13. The frame of claim 12 wherein the rear remainder portion of the sheet is attached to the central portion of the panel.

14. The frame of claim 12 wherein the rear remainder portion of the sheet is attached to the right and left retention flaps.

15. The frame of claim 9 wherein the sheet comprises a front section and a rear section as distinct pieces, wherein:

the front section comprises the front retaining and the front remainder portions of the sheet; and the rear section comprises the rear retaining and the rear remainder portions of the sheet.

16. The frame of claim 9 wherein:

the central portion defines a panel opening; and at least one of the front remainder and the rear remainder portions extends across the panel opening.

17. The frame of claim 1 wherein the central portion is continuous.

18. The frame of claim 1 wherein the frame is in the lay-flat position.

19. A packaging assembly for packaging a product, the packaging assembly comprising:

a frame according to claim 1, wherein the frame is in the retained position to retain the product; and a box to enclose and maintain the frame in the retained position.

20. A method of packaging a product comprising:

providing the frame of claim 1;

placing the product on the front remainder portion of the sheet in the central portion of the panel;

moving the right and left front pieces from their initial positions to their engaged positions to extend the front retaining portion of the sheet over the product; and positioning the frame in the retained position to retain the product between the front retaining and front remainder portions of the sheet.

* * * * *